US011162208B2

(12) United States Patent
Chae et al.

(10) Patent No.: US 11,162,208 B2
(45) Date of Patent: Nov. 2, 2021

(54) CLOTHES PROCESSING APPARATUS AND CONTROL METHOD THEREFOR

(71) Applicant: LG ELECTRONICS INC., Seoul (KR)

(72) Inventors: Aekyung Chae, Seoul (KR); Oshin Kwon, Seoul (KR); Keunjoo Kim, Seoul (KR); Jaeyong Jeong, Seoul (KR); Dongsoo Lee, Seoul (KR); Hoil Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 64 days.

(21) Appl. No.: 16/611,788

(22) PCT Filed: Jul. 4, 2018

(86) PCT No.: PCT/KR2018/007575
§ 371 (c)(1),
(2) Date: Nov. 7, 2019

(87) PCT Pub. No.: WO2019/009617
PCT Pub. Date: Jan. 10, 2019

(65) Prior Publication Data

US 2021/0079581 A1 Mar. 18, 2021

(30) Foreign Application Priority Data

Jul. 4, 2017 (KR) ..... 10-2017-0084664
Jul. 4, 2017 (KR) ..... 10-2017-0084686

(51) Int. Cl.
*D06F 39/02* (2006.01)
*D06F 39/08* (2006.01)
*D06F 39/12* (2006.01)

(52) U.S. Cl.
CPC ..... *D06F 39/024* (2013.01); *D06F 39/088* (2013.01); *D06F 39/12* (2013.01)

(58) Field of Classification Search
None
See application file for complete search history.

(56) References Cited

U.S. PATENT DOCUMENTS

2003/0145633 A1 8/2003 Merkle et al.
2003/0172690 A1 9/2003 Kim et al.
(Continued)

FOREIGN PATENT DOCUMENTS

CN 1465795 A 1/2004
CN 1712623 A 12/2005
(Continued)

OTHER PUBLICATIONS

KR 20030004711 Abstract, A device for throwing rinse in washing machine (Year: 2003).*
(Continued)

*Primary Examiner* — Cristi J Tate-Sims
(74) *Attorney, Agent, or Firm* — Finnegan, Henderson, Farabow, Garrett & Dunner LLP

(57) ABSTRACT

A laundry treating apparatus is disclosed. The laundry treating apparatus comprises a tub provided to hold wash water; a drum rotatably provided in the tub and comprising a shaft which is perpendicular to the ground; a sub-drum detachably mounted to the drum and configured to wash laundry after being inserted in an inner circumferential surface of the drum, independent from the drum; a water supply unit configured to supply wash water; and a detergent box provided in the sub-drum to store wash detergent therein and comprising a detergent discharging unit configured to discharge the wash water supplied from the water supply unit and the detergent into the sub-drum.

18 Claims, 11 Drawing Sheets

(56) References Cited

U.S. PATENT DOCUMENTS

| | | | | |
|---|---|---|---|---|
| 2005/0274157 | A1* | 12/2005 | Yang | D06F 39/022 68/17 R |
| 2015/0059417 | A1* | 3/2015 | Ramasco | D06F 39/022 68/17 A |
| 2018/0119327 | A1* | 5/2018 | Kim | D06F 37/24 |

FOREIGN PATENT DOCUMENTS

| | | | |
|---|---|---|---|
| CN | 102560973 | A | 7/2012 |
| CN | 205134025 | U | 4/2016 |
| JP | H08-332297 | A | 12/1996 |
| JP | 2004-321683 | A | 11/2004 |
| KR | 10-2003-0004711 | A | 1/2003 |
| KR | 10-2003-0012404 | A | 2/2003 |
| KR | 10-2005-0118895 | A | 12/2005 |
| KR | 10-2006-0085784 | A | 7/2006 |
| KR | 10-2015-0077059 | A | 7/2015 |
| KR | 10-2016-0084078 | A | 7/2016 |
| KR | 10-2016-0127681 | A | 11/2016 |
| WO | WO 2014/175264 | A1 | 10/2014 |
| WO | WO 2014/201534 | A1 | 12/2014 |

OTHER PUBLICATIONS

PCT International Search Report for corresponding International Application No. PCT/KR2018/007575, dated Oct. 29, 2018 (16 pages).

Examination Report of Australian Patent Application No. 2018296988, dated Jun. 29, 2020, pp. 1-12.

Chinese Office Action in Chinese Application No. 201880045015.6 dated Apr. 20, 2021 (pp. 1-9) (English translation pp. 1-14).

Korean Office Action in Korean Application No. 10-2017-0084686 dated Sep. 6, 2021 (5 pages).

* cited by examiner

CLOTHES PROCESSING APPARATUS AND CONTROL METHOD THEREFOR

CROSS-REFERENCE TO RELATED APPLICATIONS

This application is a National Phase of PCT International Application No. PCT/KR2018/007575 filed on Jul. 4, 2018, which claims the benefit of priority under 35 U.S.C. § 119(a) to Korean Patent Application Nos. 10-2017-0084664 and 10-2017-0084686, filed on Jul. 4, 2017, the contents of all of which are hereby incorporated by reference in their entireties.

FIELD

Embodiments of the present disclosure relate to a laundry treating apparatus and a control method of the same, more particularly, to a laundry treating apparatus which includes a sub-drum additionally mounted in a drum so as to perform laundry-treating in both of the drum and sub-drum.

BACKGROUND

Generally, a laundry treating apparatus includes a washer configured to perform washing, a dryer configured to perform drying and a laundry machine with washing and drying functions configured to perform both washing and drying.

Such a laundry treating apparatus is used as the washer may include a cabinet defining an external appearance; a tub mounted in the cabinet and configured to hold wash water; a drum rotatably provided in the tub and configured to wash clothes or laundry; and a door coupled to the door and provided to facilitate the loading and unloading of the clothes or laundry.

The laundry treating apparatus may be classified into a top loading type having a drum shaft which vertically stands with respect to a reference plane (e.g., the ground) and a front loading type having the drum shaft which is horizontally arranged in parallel with the ground.

In the front type laundry treating apparatus, the drum shaft is substantially parallel with the ground, and washing is performed by using a frictional force between the laundry, the drum rotated by the drive force of a motor and the drop impact of the laundry, in a state where detergent, wash water and laundry are loaded in the drum. Such a drum washing method yields little damage on the laundry and little laundry entangling, while having a washing effect like hand-rubbing-and-striking.

In the top loading type laundry apparatus, the drum shaft is substantially vertical with respect to the ground and the drum is mounted in the tub where wash water is held. The washing is performed in a state where the laundry is submerged in the wash water supplied to the drum and the top loading drum laundry apparatus is categorized into a pulsator type and an agitator type. The pulsator type includes a pulsator which is rotatably oriented in a bottom of the drum configured to accommodate wash water and laundry and rotates the wash water and the laundry by rotating the pulsator so as to perform the washing. The agitator type includes an agitator which is projected from the bottom of the drum upwardly and rotates the wash water and the laundry by rotating the agitator so as to perform the washing.

The top loading type laundry treating apparatus is configured to perform the washing by using bath the friction between the wash water and the laundry and the chemical action of the detergent which are facilitated by the rotation of the drum or the agitator or pulsator which is provided in the bottom of the drum to create water currents. Accordingly, enough wash water has to be supplied to submerge the laundry to perform the washing in the top loading type laundry treating apparatus and the top loading type laundry treating apparatus requires much wash water.

In the conventional laundry treating apparatus, a washing course, more specifically, the washing course configured of a wash cycle, a rinse cycle and a dry-spin cycle may be performed in one drum, If the laundry has to be sorted based on fabric materials, the washing course has to be performed at least two times and more operations of the laundry treating apparatus have to be performed. Accordingly, the conventional laundry treating apparatus has some disadvantages of detergent waste and energy consumption.

To solve such disadvantages, a laundry treating apparatus further including a sub-drum detachably mounted in the drum is suggested. Such a sub-drum may accommodate water, independent from the tub, and water currents may be formed in the sub-drum by the rotation of the sub-drum so as to perform an additional washing course independently.

Washing for the main-drum and washing for the sub-drum need to be independently performed. More specifically, it is preferred that the wash water held in the main-drum is not mixed with the water held in the sub-drum. If the wash water held in the main-drum and the sub-drum is mixed, there may be a concern that the laundry becomes dyed. Also, the detergent used for the laundry in the main-drum could be different from the detergent used for the laundry in the sub-drum.

More specifically, it is preferred that the supplied water is not mixed and the drained water.

Accordingly, it is necessary to provide a laundry treating apparatus which is able to effectively facilitate such independent washing processes.

Meanwhile, detergent has to be independently provided for the independent washing processes, Accordingly, a detergent box for supplying a detergent to the sub-drum needs to be provided but it is not easy to install the detergent box. In addition, not only a washing detergent but also a fabric softener may be used and it is also not easy to install such a detergent box for supplying the fabric softener as well as the washing detergent. Especially, the fabric softener has to be supplied to the sub-drum at a specific point in time (e.g., a second rising cycle or the last rinsing cycle) and it is not easy to control the precise point in time.

Moreover, when the detergent box is installed in the sub-drum, it is not easy to clean the detergent box.

DETAILED DESCRIPTION OF THE INVENTION

Technical Problem

To overcome the disadvantages, an object of the present disclosure is to solve the above-noted problems.

Another object of the present disclosure is to provide a laundry treating apparatus which includes a sub-drum easily mountable in a main-drum and which may independently separate the washing for the main-drum from the washing for the sub-drum. Especially, the object is to provide a laundry treating apparatus which may substantially separate water supply and water drainage from each other.

Furthermore, a further object of the present disclosure is to provide a laundry treating apparatus which may achieve a sufficient washing effect by using only the sub-drum.

Still further, a still further object is to provide a laundry treating apparatus Which may allow a user to additionally load laundry in the main-drum as well as the sub-drum.

Still further, a still further object is to provide a laundry treating apparatus which may effectively discharge wash water from the sub-drum, without being drawn into the main-drum.

Still further, a still further object is to provide a laundry treating apparatus which may discharge the wash water held in the sub-drum only in a dry-spinning cycle, without discharging the wash water in a washing cycle. Especially, the laundry treating apparatus may realize the object of the water discharging structure, without an auxiliary drive unit such as a drainage pump connected with the sub-drum.

Still further, a still further object is to provide a laundry treating apparatus which may prevent water leakage to a sensor provided in a tub cover to sense the rotation of the sub-drum during the washing and which discharge the water collected in the tub cover quickly, while preventing the water from flowing back up to an outlet hole provided to discharge.

Still further, a still further object is to provide a laundry treating apparatus including an independent box provided to supply a detergent to the sub-drum from a detergent box Still further, a still further object is to provide a laundry treating apparatus which may Supply a detergent to the sub-drum, together with the wash water supplied with no auxiliary water supply pipe.

Still further, a still further object is to provide a laundry treating apparatus which includes a detergent box provided in the sub-drum and configured to accommodate a fabric softener as well as a washing detergent. Accordingly, a user is able to use the laundry treating apparatus conveniently.

Still further, a still further object is to provide a laundry treating apparatus may supply the fabric softener only at a precise point in time (e.g., in a washing cycle, an intermediate spinning cycle after the washing cycle or an intermediate spinning cycle after the first rinsing cycle), through control of the drum position, control of a water supply point and the structure of the detergent box.

Still further, a still further object is to provide a laundry treating apparatus including a detergent box configured to prevent the fabric softener from being supplied to the sub-drum at the other points of time except a precise point in time (e.g., in a washing cycle, an intermediate spinning cycle after the washing cycle or an intermediate spinning cycle after the first rinsing cycle, when a proper amount of a fabric softener is supplied to the detergent box.

Technical Solution

To achieve these objects and other advantages and in accordance with the purpose of the embodiments, as embodied and broadly described herein, a laundry treating apparatus comprises a tub provided to hold wash water; a drum rotatably provided in the tub and comprising a shaft which is perpendicular to the ground; a sub-drum detachably mounted to the drum and configured to wash laundry after inserted in an inner circumferential surface of the drum, independent from the drum; a water supply unit configured to supply wash water; and a detergent box provided in the sub-drum to store wash detergent therein and comprising a detergent discharging unit configured to discharge the wash water supplied from the water supply unit and the detergent into the sub-drum.

The detergent box may comprise a wash water inlet hole that is open upwardly, and the wash water falling from the water supply unit may be drawn into the detergent box via the wash water inlet hole.

The detergent discharging unit may be provided to discharge the detergent together with the wash water by a siphon effect.

The detergent discharging unit may comprise a siphon pipe configured to facilitate communication between an inside of the detergent box and an inside of the sub-drum; and a siphon cap configured to form a siphon path by covering the siphon pipe.

The detergent box may be provided an upper end edge of the sub-drum and comprising a lower cap provided under the siphon pipe to prevent the wash water held in the sub-drum from being drawn into the siphon pipe after rising along an inner circumferential surface of the sub-drum during the rotation of the sub-drum.

The detergent box may be retractable in a radial direction from the inside of the sub-drum or upwardly with respect to the sub-drum.

The sub-drum may comprise a holding portion recessed to hold the detergent box, and the holding area may comprise a guide groove formed by recessing one side of the holding portion to guide the holding process of the detergent box; and a holding guide projected to insertedly guide the detergent box in the guide groove.

A buffering space may be formed in the holding guide to accommodate the detergent concentrated in a direction in which the centrifugal force generated by the rotation of the sub-drum is actuated.

A cross section of the drum may be circular, and the sub-drum may comprise a coupling area coupled to an inner circumferential surface of the drum; and a spaced area spaced a preset distance apart from the inner circumferential surface of the drum, and the coupling area and the spaced area may be alternately provided along a circumference of the sub-drum.

The detergent box may be adjacent to the coupling area.

The sub-drum may further comprise a body provided to hold laundry and wash water; and a sub-cover coupled to an upper surface of the body and having a laundry introduction opening to load the laundry, and the sub-cover comprising a handle unit formed by recessing one side of the sub-cover and provided adjacent to the coupling area.

The detergent box may be provided under the handle unit.

The detergent box may comprise a plurality of chambers partitioned off by a partition wall and provided to accommodate a detergent; and a communication hole provided in the partition wall with a preset height and configured to facilitate communication between the chambers to discharge the accommodated detergent while sequentially passing the chambers according to the size of the centrifugal force generated by the rotation of the sub-drum.

The detergent box may comprise a chamber defined by a shut-off rib projected from an inner surface to selectively shut off the moving of the detergent drawn via the communication hole according to the size of the centrifugal force, and the height of the communication hole becomes smaller according to the order of the partition walls through which the wash water passes by the centrifugal force.

The detergent box may comprise an accommodation body in which the plurality of the chambers is provided; and a body cover detachably coupled to an upper end of the accommodation body.

The detergent box may comprise a first chamber configured to supply fabric softener from outside; a second chamber provided to accommodate the fabric softener flowing over the first chamber as the sub-drum is rotated at a first rpm in a dry-spinning cycle after a washing cycle; and a third chamber provided to accommodate the fabric softener flowing over the second chamber as the sub-drum is rotated at a second rpm lower than the first rpm in the dry-spinning after a first rinsing cycle, and a detergent discharging unit configured to discharge the fabric softener together with the wash water supplied to the third chamber from the water supply unit in a second rinsing cycle into the sub-drum by a siphon effect.

The detergent box may comprise a detergent box provided to accommodate a washing detergent; and a detergent box provided to accommodate a fabric softener and provided in the reverse side of the detergent box provided to accommodate the washing detergent.

The sub-drum may comprise a sub-cover having a laundry introduction opening to load the laundry; and a handle unit provided in each of both sides of the sub-cover, and the detergent box provided to hold the washing detergent and the detergent box provided to accommodate the fabric softener are provided under the handle unit.

The laundry treating apparatus may further comprise a control unit configured to control the detergent box accommodating the washing detergent to be located under the water supply unit during the washing cycle and control the water supply of the water supply unit, and the control unit configured to control the detergent box accommodating the fabric softener to be located under the water supply unit during the rinsing cycle and control the water supply of the water supply unit.

A siphon pipe may be provided only in the detergent box provided to accommodate the fabric softener, and the siphon pipe may be located at a center of the detergent box in a circumferential direction of the detergent box.

In some embodiments, a laundry treating apparatus comprises a tub provided to hold wash water; a drum rotatably provided in the tub and comprising a shaft which is perpendicular to the ground; a sub-drum detachably mounted to an inner circumferential surface of the drum and configured to wash laundry, independent from the drum; a tub cover provided in an upper surface of the tub and comprising a laundry introduction opening formed therein; a sensing object unit provided in the sub-drum; and a sensor unit provided in the tub cover and configured to sense the sensing object unit.

When the sub-drum is mounted in the drum, an upper end of the sub-drum may be partially located higher than the tub cover.

The tub cover may be extended towards an inner area with respect to a radial direction from an upper area of the tub. The sensing object may be located in an upper area of the sub-drum, more specifically, a cover of the sub-drum.

Accordingly, the height of the sensor unit may be approximately equal to that of the sensing object unit by locating the sensor unit in the upper area of the tub cover. Also, the distance between the sensor unit and the sensing object may become small such that the sensor unit can effectively sense the sensing object.

The laundry treating apparatus may further comprise a mounting portion provided in the tub cover to mount the sensor unit therein, wherein the mounting portion is provided to surround the sensor unit to protect water from being drawn into the sensor unit.

The mounting portion may comprise an accommodating area provided in the tub cover and provided to accommodate the sensor unit. The accommodating area may be formed in a chamber shape recessed from the tub cover and the sensor unit is inserted in the chamber to be surrounded therein.

The mounting portion may further comprise an accommodating area cover rotatably provided in the tub cover and configured to selectively close the accommodating area. The accommodating area cover covers an opening formed in a top of the accommodating area to substantially seal the inside of the chamber.

The mounting portion may further comprise a hinge unit configured to rotatably connect the accommodating area cover to the tub cover. Accordingly, the hinge unit may facilitate the mounting of the sensor unit via the accommodating area cover.

The mounting portion may be integrally injection-molded with the tub cover. Accordingly, the structure and the assembling process can be simple and easy.

The hinge unit is formed between the mounting portion and the accommodating area cover, with a smaller thickness than the accommodating area cover, to be foldable. As the hinge unit is integrally formed with the mounting portion and the accommodating area cover, the assembling process may be easy. Even when the accommodating area cover is open, the accommodating area cover may not be separated and thus it is convenient to fabricate.

The hinge unit may be located in an inner area with respect to a radial direction of the tub cover, and the accommodating area cover may cover the mounting portion, as being folded towards an outer area with respect to the radial direction of the tub cover via the hinge unit. The location of such a hinge unit may facilitate the process of integrally forming the accommodating area cover and the hinge unit with the tub cover. Also, as there is no gap in the hinge unit, the water drawn into the hinge unit may be prevented effectively.

The laundry treating apparatus may further comprise a fixing unit comprising a cover hook provided in the accommodating area cover; and a hook groove provided in the accommodating area and configured to be coupled to the cover hook. It is preferred that the cover hook and the hook groove are integrally formed with the tub cover.

The cover groove may facilitate communication of the accommodating area with the outside by inserting expose the cover hook therein. In other words, the cover hook may be inserted in the hook groove from the inside of the accommodating area such that moisture may be effectively prevented from being drawn therein.

The accommodating area may be partitioned off into a sensor seating area provided to seat the sensor unit therein; and a damping area in communication with the outside via the hook groove. In other words, the accommodating area may be partitioned off into the sensor seating area and the damping area by a partition wall or rib provided in the accommodating area.

The accommodating area may comprise a blocking protrusion provided in the accommodating area to prevent water from flowing between the sensor seating area and the damping area. Accordingly, even if moisture is drawn into the accommodating area, the moisture will not be drawn into the sensor seating area.

The accommodating area cover may comprise a pair of support projections configured to support both ends of the sensor unit to prevent the movement of the sensor unit caused by the rotation of the sub-drum. The pair of the support projections may be provided in inner and outer areas with respect to the radial direction and a sensor may be located between the support projections, only to stably fix the sensor.

The laundry treating apparatus may further comprise a cover discharging unit provided in the tub cover and configured to discharge the water collected in an upper area of the tub cover to a lower area of the tub cover. A plurality of such cover discharging units may be provided along a circumferential direction of the tub cover.

The moisture or water flowing along the upper area of the tub cover may be discharged into the lower area of the tub cover via the cover discharging units before reaching the accommodating area.

The laundry treating apparatus may further comprise a water supply unit provided in an upper rear area of the tub cover and configured to supply wash water, wherein the tub cover comprises a shut-off rib configured to shut off the water discharged from the water supply unit from being moved towards the sensor unit along the upper area of the tub cover.

The sensor unit may be provided in the upper area of the tub cover, adjacent to the water supply unit. Accordingly, the moisture or water flowing towards the sensor unit may be blocked by the cover discharging unit in one side of the sensor unit and blocked by the shut-off rib in the other side of the sensor unit.

Embodiments of the present disclosure may also provide a laundry treating apparatus comprising a tub provided to hold wash water; a drum rotatably provided in the tub and comprising a shaft which is perpendicular with the ground; a sub-drum detachably mounted to an inner circumferential surface of the drum and configured to wash laundry, independent from the drum; a tub cover provided in an upper surface of the tub and comprising a laundry introduction opening formed therein; a magnet unit provided in the sub-drum; a hall sensor provided in the tub cover and configured to sense the magnet unit; and a mounting portion provided in the tub cover and configured to mount the hall sensor to the tub cover and prevent water from being drawn into the hall sensor.

When the hall sensor senses the magnet unit, it may be determined that the sub-drum is mounted in the drum.

The magnet unit is strong in the moisture or water. On the other hand, the hall sensor is connected with a signal wire and it is weak in the moisture. Accordingly, it is preferred that the hall sensor is protected from the moisture or water. On the other hand, the hall sensor may be located adjacent to the magnet unit. With that reason, the hall sensor may be mounted in the mounting portion and it is necessary to prevent the moisture or water from being drawn into the hall sensor via the mounting portion.

The mounting portion may comprise an accommodating area recessed from the tub cover and provided to accommodate the sensor unit; and a cover area comprising an accommodating area cover rotatably provided in the tub cover and configured to selectively close the accommodating area and a hinge unit configured to rotatably connect the accommodating area cover to the tub cover.

The laundry treating apparatus may further comprise a fixing unit comprising a cover hook provided in the accommodating area cover; and a hook groove recessed from some area of the accommodating area to have the cover hook insertedly coupled thereto.

The hook groove may facilitate communication the accommodating area with the outside to expose one end of the inserted cover hook. Accordingly, the cover hook may be inserted in the hook groove from the inside towards the outside of the accommodating area.

The accommodating area may be partitioned off into a sensor seating area provided to seat the sensor unit therein; and a damping area in communication with the outside via the hook groove by a blocking protrusion provided in a lower surface of the accommodating area.

The thickness of the hinge unit may be smaller than the thickness of the accommodating area and the accommodating area cover. Accordingly, the hinge unit may be structurally foldable.

The hinge unit may be located in an inner area with respect to a radial direction of the tub cover, and the accommodating area cover is rotated towards an outer area with respect to the radial direction from the hinge unit to cover the accommodating area.

The laundry treating apparatus may further comprise a water supply unit provided in an upper rear area of the tub cover and configured to supply wash water, wherein the tub cover comprises a shut-off rub configured to shut off the water discharged from the water supply unit from being moved towards the sensor unit along the upper area of the tub cover; and a plurality of cover discharging units provided from an upper area of the tub cover along a circumferential direction and configured to discharge the water collected in the upper area of the tub cover to a lower area of the tub cover, and the sensor unit is located between the shut-off rib and the cover discharging unit.

Accordingly, the sensor protection of the mounting portion structure and the moisture blocking of the shut-off rib and the cover discharging unit may be actuated combinedly.

Detailed characteristics of the embodiments may be realized combinedly in other embodiments, unless they are contradictory or exclusive.

Advantageous Effects

The embodiments have following advantageous effects. According to the embodiments of the present disclosure, the laundry treating apparatus includes a sub-drum easily mountable in a main-drum and which may independently separate the washing for the main-drum from the washing for the sub-drum. Especially, the object is to provide a laundry treating apparatus which may substantially separate water supply and water drainage from each other.

Furthermore, the laundry treating apparatus may achieve a sufficient washing effect by using only the sub-drum.

Still further, the laundry treating apparatus may allow a user to additionally load laundry the main-drum as well as the sub-drum.

Still further, the laundry treating apparatus may effectively discharge wash water from the sub-drum, without being drawn into the main-drum.

Still further, the laundry treating apparatus may discharge the wash water held in the sub-drum only in a dry-spinning cycle, without discharging the wash water in a washing cycle. Especially, the laundry treating apparatus may realize the object of the water discharging structure, without an auxiliary drive unit such as a drainage pump connected with the sub-drum.

Still further, the laundry treating apparatus may prevent water leakage to a sensor provided in a tub cover to sense the rotation of the sub-drum during the washing and which discharge the water collected in the tub cover fast, while preventing the water from flowing back up to an outlet hole provided to discharge.

Still further, the laundry treating apparatus includes an independent box provided to supply a detergent to the sub-drum from a detergent box.

Still further, the laundry treating apparatus may supply a detergent to the sub-drum, together with the wash water supplied with no auxiliary water supply pipe.

Still further, the laundry treating apparatus includes a detergent box provided in the sub-drum and configured to accommodate a fabric softener as well as a washing detergent. Accordingly, a user is able to use the laundry treating apparatus conveniently.

Still further, the laundry treating apparatus may supply the fabric softener only at a precise point in time (e.g., in a washing cycle, an intermediate spinning cycle after the washing cycle or an intermediate spinning cycle after the first rinsing cycle), through control of the drum position, control of a water supply point and the structure of the detergent box.

Still further, the laundry treating apparatus may include a detergent box configured to prevent the fabric softener from being supplied to the sub-drum at the other points of time except a precise point in time (e.g., in a washing cycle, an intermediate spinning cycle after the washing cycle or an intermediate spinning cycle after the first rinsing cycle, when a proper amount of a fabric softener is supplied to the detergent box.

Still further, the laundry treating apparatus may include a detergent box accommodating a washing detergent and a detergent box accommodating a fabric softener which are arranged in both sides of the sub-drum, respectively. Accordingly, the washing detergent and the fabric softener may be prevented from being mixed with each other when loading the washing detergent and the fabric softener.

DESCRIPTION OF SPECIFIC EMBODIMENTS

Referring to the accompanying drawings, exemplary embodiments of the present disclosure according to one embodiment of the present disclosure will be described in detail. Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that the embodiments presented herein are not limited by the accompanying drawings.

Figure 1:
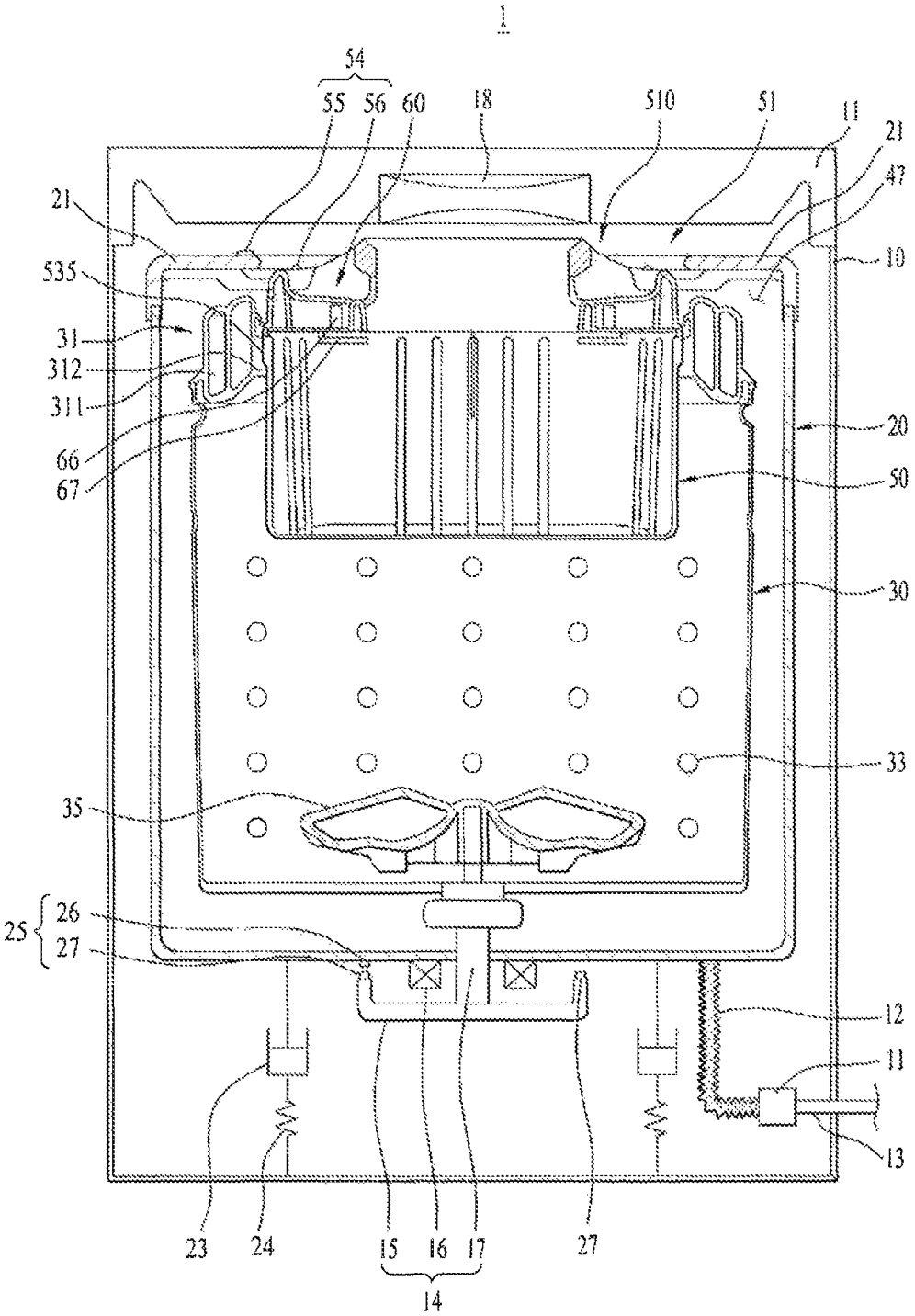
FIG. 1 is a schematic diagram illustrating a structure of a laundry treating apparatus in accordance with one embodiment of the present disclosure.

FIG. 1 is a schematic diagram illustrating a structure of a laundry treating apparatus 1 in accordance with one embodiment of the present disclosure.

Referring to FIG. 1, the laundry treating apparatus 1 in accordance with the embodiment includes a cabinet 10 having an opening formed in an upper portion to load clothes or laundry (hereinafter, the laundry); a door (not shown) coupled to the opening to open and close the opening; a tub 20 mounted in the cabinet 10 and configured to store wash water; and a drum 30 rotatably mounted in the tub 20.

The laundry treating apparatus may further include a drive unit 14 configured to drive the drum 30; and a pulsator 35 configured to rotate in the drum 30 so as to form water currents in the wash water supplied to the drum and the tub.

The drive unit 14 may be provided to selectively rotate the drum 30 and the pulsator 35.

Meanwhile, the laundry treating apparatus in accordance with the embodiment includes a sub-drum 50 detachably mounted in the drum 30 and configured to perform washing, independent from the washing in the drum 30.

In the embodiments of the present disclosure, the wash water for washing the laundry and the wash water for washing the door and the like are referred to as 'the wash water' and the drum 30 is referred to as 'the main-drum'.

FIG. 1 shows a direct-type motor drive structure which directly connects a motor to a shaft 17 to drive the drum 30. However, the laundry treating apparatus 1 in accordance with the illustrated embodiment is not limited thereto.

The cabinet 10 may define the exterior appearance of the laundry treating apparatus 1 and include a cabinet cover 11 having an opening to communicate the inside of the cabinet with the outside so as to load the laundry.

The cabinet cover 11 is provided in an upper end of the cabinet 10 and the door (not shown) is rotatably coupled to a top of the opening to selectively open and close the opening. Accordingly, a user is able to load or unload the laundry into or from the drum 30 and the sub-drum by opening and closing the door.

Meanwhile, a water supply unit 18 is provided in the cabinet cover 11 to supply the water mixed with detergent or clean water with no detergent to the drum 30 and the sub-drum 50 The wash water exhausted from the water supply unit 18 may be supplied to the drum 30 and/or the sub-drum 50.

The wash water exhausted from the water supply unit 18 may be supplied only to the drum 30 or only to the sub-drum 50. It is necessary not only to separate a laundry accommodating space of the drum 30 from a laundry accommodating space of the sub-drum 50 but also to separate the wash water supplied to the drum 30 from the wash water supplied to the sub-drum 50. In other words, it is necessary to limit the supply of the wash water supplied to the sub-drum 50 and to the drum 30 and vice versa, because a contamination level or fabric type of the laundry loaded in the drum could be different from a contamination level or fabric type of the laundry loaded in the sub-drum. Accordingly, it is also necessary to separate the laundry and the wash water supplied to the drum from the laundry and the wash water supplied to the sub-drum.

In the illustrated embodiment, the wash water is selectively supplied to the drum 30 or the sub-drum 50 via the inside of the tub 20 based on the rotation of the sub-drum 50. In other words, the wash water may be directly supplied to the internal space of the drum 30, not passing through the internal space of the sub-drum and the internal space of the sub-drum 50, not passing through the internal space of the drum 30. The wash water supplied to the drum 30 and the wash water supplied to the sub-drum 50 are not mixed during the wash cycle and it is preferred that they are not mixed in the internal space of the drum 30 and the internal space of the sub-drum 50 even during the dry-spin cycle and the water drainage process.

The tub 20 is formed in a cylinder shape with an open top and mounted in the cabinet 10 to accommodate the wash water. The tub 20 includes a tub cover 21 installed at an upper end.

The tub cover 21 may be located higher than an upper end of the drum 30 and an upper end of the sub-drum 50 mounted in the drum 30. A laundry introduction opening 580 is formed in the tub cover 21, corresponding to the opening of the cabinet 10. The laundry may be loaded into the drum or the sub-drum via the laundry introduction opening 580.

A lower surface of the tub 20 is flexibly supported by a spring 24 and a damper 23 which are installed in the cabinet 10. As the lower surface is directly supported by the spring 24 and the damper 23, the tub 20 may be configured so as not to rotate relative to the drum 30. For example, the tub may not be provided with an auxiliary rotational force by the drive unit 14, different from the drum 30. FIG. 1 shows that the spring 24 and the damper 23 are serially connected to the lower surface of the tub 20 and the embodiments of the present disclosure are not limited thereto. If necessary, the spring 24 and the damper 23 may be connected to the lower surface in parallel. Alternatively, the damper 23 may be connected to the lower surface of the tub 20 and the spring 24 may be connected to an upper surface of the tub 20 and vice versa.

A drainage mechanism configured to drain water may be connected to the lower surface of the tub 20. The drainage mechanism includes a drainage pump 12*b* for providing a power to drainage the wash water held in the tub 20; a first drainage pipe 12 having one end connected to the lower surface of the tub and the other end connected with the drainage pump 12*b* so as to guide the wash water toward the drainage pump 12*b;* and a second drainage pipe 13 having one end connected with the drainage pump 12*b* and the other end connected with one side of the cabinet 10 so as to drain the wash water outside the cabinet 10 from the drainage pump 12*b*. The first drainage pipe 12 may be a bellows pipe not to transfer the vibration of the tub 20 to the drainage pump 12*b*.

The drive unit 14 includes a motor configured of a rotor 15 and a stator 16; and a shaft 17 connected with the rotor 15, As a clutch (not shown) is provided in the drive unit 14, the drive force may be transferred to the drum 30 and the pulsator 35. For example, when the shaft 17 is selectively coupled to the drum 30 in a state of being fixed to the pulsator 35, the drive unit 14 may transfer the drive force to the pulsator 35 or both of the pulsator 35 and the drum 30. As another example, the shaft 17 is selectively coupled to the pulsator in a state of being fixed to the drum 30 and the drive unit 14 may then transfer the drive force to the drum 30 or both of the pulsator 35 and the drum 30.

As mentioned above, the shaft 17 may be fixed to one of the pulsator 35 and the drum 30 and selectively coupled to the other one. However, such description may not exclude the structure configured to selectively couple the shaft only to the pulsator 35 or the drum 30.

The laundry treating apparatus 1 in accordance with one embodiment includes the drum 30 rotatably mounted in the tub 20 and configured to hold clothes or laundry; and the sub-drum 50 detachably mounted in the drum 30.

The drum 30 may be formed in a cylinder shape with an open top and an approximately circular cross-section and a lower surface directly connected with the shaft 17 to receive the rotational force from the drive unit 14.

The drum 30 may be formed in the cylinder shape with the open top and a plurality of through-holes may be formed in a lateral wall, in other words, a circumferential surface. The drum 30 may be in communication with the tub 20 via a plurality of through-holes 33. Accordingly, when wash water is supplied to the tub 20 to a preset water level or more, the drum 30 becomes submerged in the wash water and some of the wash water may flow into the drum via the through-holes 33.

The drum 30 includes a drum cover 31 provided in an upper end. The drum cover 31 is formed in a hollow ring shape and arranged in a lower area of the tub. An outlet path 47 is horizontally extended by the upper surface of the drum cover 31 and the lower surface of the tub cover 21. The outlet path 47 may be provided to guide the wash water exhausted outside via a lateral surface of the sub-drum 50 toward the inside of the tub 20 again.

The wash water held in the drum 30 is drawn toward inner and lower walls of the tub via the through-holes 33 of the drum 30 and then drained. The wash water held in the sub-drum 50 is drawn toward the inner wall of the tub via the top of the sub-drum 50. In other words, the wash water flows in a side gap between the drum 30 and the tub 20 via the outlet path 47 and then to the lower wall of the tub to be drained outside. Accordingly, the wash water held in both the drum 30 and the sub-drum 50 is not mixed with each other in the drum 30 and the sub-drum 50, when drained outside. Also, the wash water supplied to both the drum 30 and the sub-drum 50 is not mixed with each other.

The drum cover 31 has an opening so as to load the laundry or mount the sub-drum 50 therein. Also, the drum-cover 31 also has a balancer 311 provided to compensate the unbalance caused by an eccentric load of the laundry in the drum.

The drum cover 31 may include a first uneven portion 312 formed in an inner circumferential surface to facilitate the demounting of the sub-drum 50; and an uneven area 312 projected from the inner circumferential surface to prevent the upward movement of the drum 30 by interfering with a coupling unit 93 of the sub-drum 50 which is provided to be coupled to the first uneven portion 312. The uneven area 312 may include a hooking portion. In this instance, the coupling unit 93 is able to be flexibly movable into or from the sub-drum 50, in communication with a handle unit 510.

Figure 6:
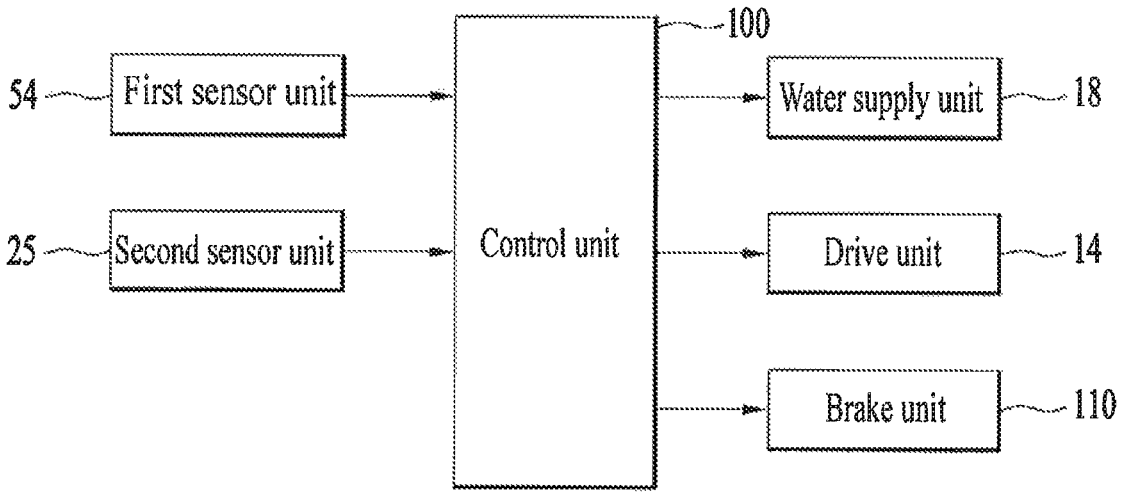
FIG. 6 is a block diagram illustrating the structure of the laundry treating apparatus in accordance with the embodiment.

Meanwhile, the laundry treating apparatus in accordance with the embodiment may include a control unit (100, see FIG. 6 and a brake unit (110, see FIG. 6) so as to control the overall washing process. Also, the laundry treating apparatus may include a sensor unit configured to control an angle of the sub-drum 50 which will be described later. The sensor unit may include a first sensor unit 54 and a second sensor unit 25. The angle control of the sub-drum 50 may be performed for the water supply. As one example, it may be determined based on the angle control of the sub-drum 50 whether to perform the water supply to the inside of the drum 30 via the same water supply unit or to the inside of the sub-drum 50.

The first sensor unit 54 may include a first hall sensor 55 and a first magnet unit 56. The first hall sensor 55 may be provided in an upper surface of the tub cover or an inner circumference of the tub cover 21. In other words, the first hall sensor 55 may be provided in one of the fixed elements. The first magnet unit 56 may be installed on an upper surface of the sub-drum to be sensed by the first hall sensor 55.

When the sub-drum 50 is rotated, the first hall sensor 55 senses the first magnet unit 56 and transmits a signal to the control unit 100. In the illustrated embodiment, one hall sensor and one magnet are provided in the first sensor unit 54 for easy understanding. However, the embodiments of the present disclosure are not limited thereto and the first sensor unit 54 may include a plurality of hall sensors and a plurality of magnets. Or, it may include one hall sensor and a plurality of magnets. The plurality of magnets may be arranged at intervals having a preset angle. When one magnet is provided in one hall sensor, the hall sensor may generate one magnet sensing signal per one rotation of the sub-drum 50. When three magnets are provided in one hall sensor, the hall sensor may generate three magnet sensing signals per one rotation of the sub-drum 50. The first sensor unit 54 may determine whether the sub-drum 50 is mounted in the drum 30, Also, the first sensor unit 54 may determine whether the sub-drum 50 is mounted in the drum 30 normally.

As one example, when the first hall sensor 55 generates three magnet sensing signals per one rotation of the drum 30, the first hall sensor 55 may generate only two magnet sensing signals. In this instance, it may be determined that the sub-drum 50 is mounted in the drum abnormally.

When it is determined that the sub-drum 50 is mounted in the drum 30 normally, the sub-drum 50 and the drum 30 may be integrally rotated as one body. In other words, the rotation angle of the sub-drum 50 may be controlled by controlling the rotation angle of the drum 30.

In this embodiment, the second sensor unit 25 may be provided to control the rotation angle of the drum 30. More specifically, the sensor unit 25 may be provided to sense the rotation angle of the drum 30 and the rotation angle of the drum 30 may be controlled based on the result of the sensing of the second sensor unit.

More specifically, the second sensor unit 25 may include one second hall sensor 26 and a second magnet unit 27 so as to sense the rotation angle of the drum 30. The second hall sensor 26 may be provided on a bottom surface of the tub 20 and magnets of the second magnet unit 27 may be arranged along an outer circumference of a top surface of the rotor 15 to be sensed by the second hall sensor 26. When the drum 30 is rotated, the second hall sensor 26 senses the rotation angle of the drum 30 and then transmits a signal to the control unit 100. To allow the second sensor unit 25 to sense the precise rotation angle of the drum 30, the magnets of the second magnet unit 27 are provided on the rotor 15 at the equidistant intervals. The more magnets provided, the more precise rotation angle of the drum may be sensed. In other words, the rotation angle of the drum 30 is determined based on the rotation angle of the rotor 15 sensed by the second sensor unit 25. Meanwhile, the second sensor unit 25 may include the hall sensor fixedly provided on the stator; and a plurality of magnets provided on the rotor and rotatable together with the rotor.

Meanwhile, the rotation angle of the rotor 15 may be sensed without auxiliary sensors. In other words, the rotation angle of the rotor 15 may be sensed according to a sensorless Method to determine the rotation angle of the drum 30. Such a sensorless method may be configured to allow a phase current of a preset frequency to flow to the motor and estimate the location of the rotor provided in the motor based on the output currents detected while the currents of the preset frequency flow to the motor. Such the sensorless method may be well-known knowledge and detailed description thereof will be omitted accordingly.

The control unit 100 is configured to control the overall operation of the laundry treating apparatus (e.g., the wash cycle, the rinse cycle, the dry-spin cycle and the like) and operate the laundry treating apparatus according to the user's setting.

Especially, the control unit 100 may be implemented to receive the signals generated by the first sensor unit 54 and the second sensor unit 25 and control the drive unit 14 configured to rotate the drum 30, the water supply unit 18 configured to supply wash water and the brake unit 110 configured to apply a brake to the rotating drum 30 based on the received signals. The control unit may perform the control of the rotation angle of the sub-drum 50 based on the control of the rotation angle of the drum 30. In other words, the control unit may control the sub-drum 50 to stop at a desired rotation angle.

The brake unit 110 is implemented to stop the drum 30 by applying a brake to the rotating drum 30. In other words, the control unit may control the drum 30 and the sub-drum 50 to stop at a preset rotation angle.

Hereinafter, the sub-drum 50 will be described in detail, referring to FIGS. 2 through 4.

Figure 2:
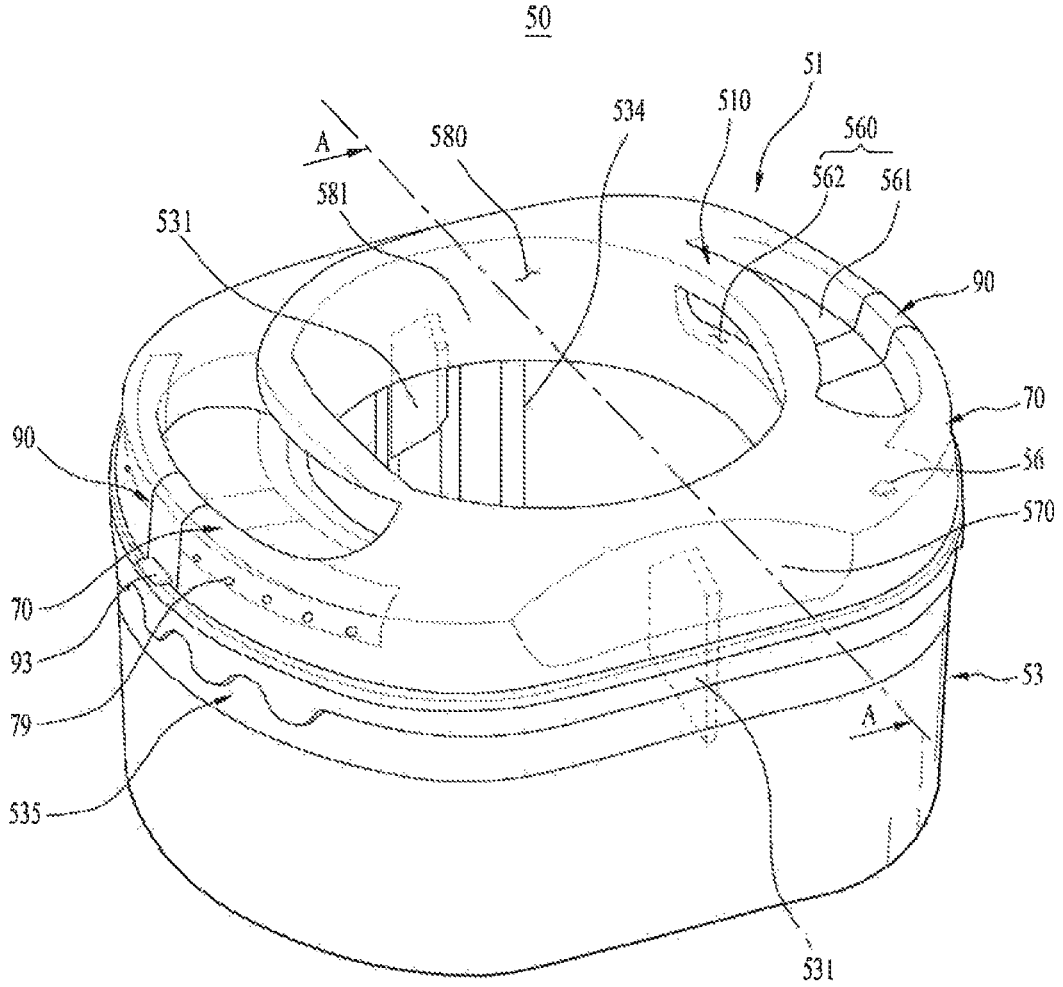
FIG. 2 is a perspective diagram illustrating a sub-drum which is shown in FIG. 1.
Figure 3:
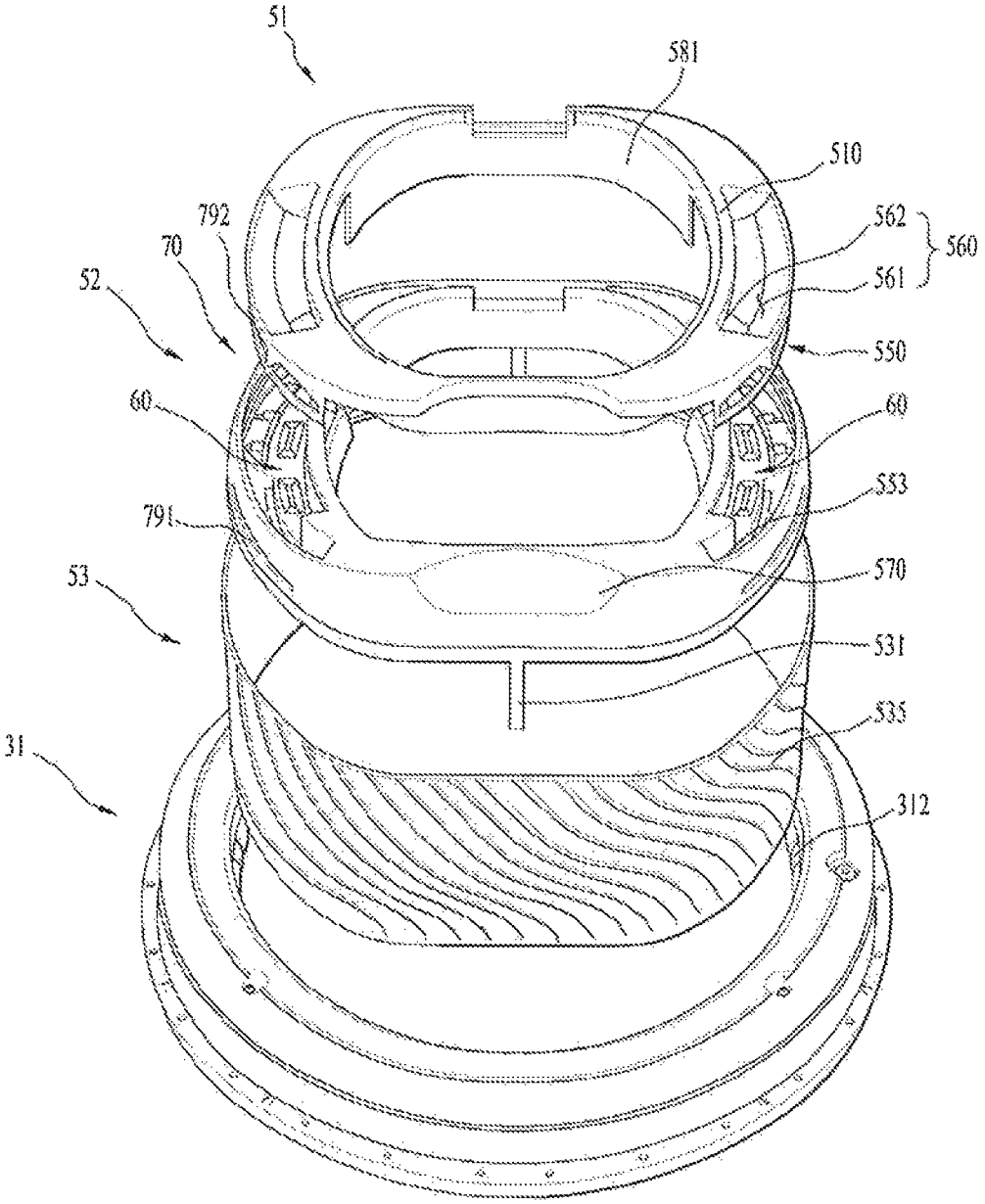
FIG. 3 is an exploded perspective diagram of the sub-drum shown in FIG. 1.

FIG. 2 is a perspective diagram illustrating the sub-drum 50 which is shown in FIG. 1. FIG. 4 is a sectional diagram along a line A-A which is shown in FIG. 2. FIG. 5 is a plane view illustrating the sub-drum 50 mounted in the drum 30. FIG. 3 is an exploded perspective diagram of the sub-drum shown in FIG. 1.

Referring to FIGS. 2 through 5, the sub-drum 50 may be detachably mounted in an upper end area of the drum 30. The sub-drum 50 has a kind of a container shape with an open top. The laundry may be loaded or unloaded through the open top. Also, wash water may be supplied to the internal space of the sub-drum via the open tope and a cross section of the sub-drum may be formed in an approximately circular shape.

The sub-drum 50 may be configured to perform washing, independent from the drum 30. After the laundry is sorted according to the color or fabric type and dividedly loaded into the drum 30 and the sub-drum 50, washing is performed for the laundry supplied to the drum and the sub-drum simultaneously. Accordingly, the operation frequency of the laundry treating apparatus 1 may be reduced and the waste of the wash water, detergent and energy may be prevented at the same time. Also, the laundry may be sorted according to a contamination degree or the user's intended use of the laundry. As one example, laundry items such as lingerie or underwear may be dividedly washed from the laundry items which are used in cleaning such that the user's satisfaction level about the separated washing may be remarkably enhanced. In addition, the water supply and drainage may be separately performed and the separated washing effect may be substantially enhanced.

The sub-drum 50 may perform the washing while being rotated by the rotational force transmitted from the drum 30 such that no auxiliary drive device need be provided. That is because the sub-drum may be integrally rotated together with the drum.

The sub-drum 50 includes a sub-drum body 53 formed in a cylinder shape with an open top; a sub-drum cover 51 detachably coupled to an upper end of the sub-drum body 53; a discharge area 70 configured to exhaust the wash water held in the sub-drum 50 outside when the sub-drum 50 is rotated at a high speed; and a coupling unit 93 configured to couple and decouple the sub-drum 50 to and from the drum 30.

The sub-drum body 53 has an oval cross section so as to form a vortex in the wash water and a friction rib 534 may be provided in an inner circumferential surface of the sub-drum body 53 to form a water current in the wash water.

The top loading type laundry treating apparatus 1 in accordance with the embodiment may perform the washing process by using the chemical action of the detergent and the friction between the water currents formed by the rotation of the drum and the laundry. The sub-drum body 53 having the oval-shaped cross section may generate the vortex by using the rotation more efficiently than the drum having the circular-shaped cross section. As the vortex increases the friction between the wash water and the laundry, the sub drum 50 having the oval-shaped cross section may enhance the washing efficiency.

Meanwhile, the sub-drum body 53 may include an inner circumferential surface formed with a first curvature area (C1) having a first curvature and a second curvature area (C2) having a second curvature which is smaller than the first curvature, as shown in FIG. 5.

A pair of first curvature areas (C1) may be formed in the areas of the sub-drum body 53 which face each other, respectively, and the first curvature is identical to the curvature of the inner circumferential surface of the opening formed in the drum cover 31.

A pair of second curvature areas (C2) may be formed in the opposite areas of the sub-drum body 53 which face each other, respectively, with being located between the first curvature areas (C1). The second curvature may be smaller than the first curvature.

In other words, the first curvature areas (C1) and the second curvature areas (C2) may be alternatively provided along a circumference of the cross sectional surface formed in the sub-drum body 53.

The inner circumferential surface of the sub-drum body 53 may be divided into a short distance area (C2) spaced a first distance apart from the rotational center of the sub-drum 50; and a long distance area (C1) spaced a second distance apart from the rotation center of the sub-drum 50, the second distance farther than the first distance. The long distance area (C1) corresponds to the first curvature area (C1) and the short distance area (C2) corresponds to the second curvature area (C2).

Meanwhile, a first water supply path 573 which will be described later may be formed as the short distance area (C2) is spaced a sufficient distance apart from the inner circumferential surface of the drum-cover 31.

It is described that some area of the inner circumferential surface which the second curvature area (C2) indicates is curved but the embodiments of the present disclosure are not limited thereto. The area of the inner circumferential surface may be planar. In this instance, it is more appropriate that the second curvature area (C2) is named the short distance area (C2).

The first curvature area (C1), the second curvature area (C2), the long distance area (C1), the short distance area (C2), a coupling area (C1) and a distant area (C2) indicate specific areas. All of the areas which belong to the above-noted specific areas may be referred to as the terms mentioned above. In the disclosure, some areas of the sub-drum body 53 and the sub-drum cover 51 are referred to as the above-noted terms.

Figure 4:
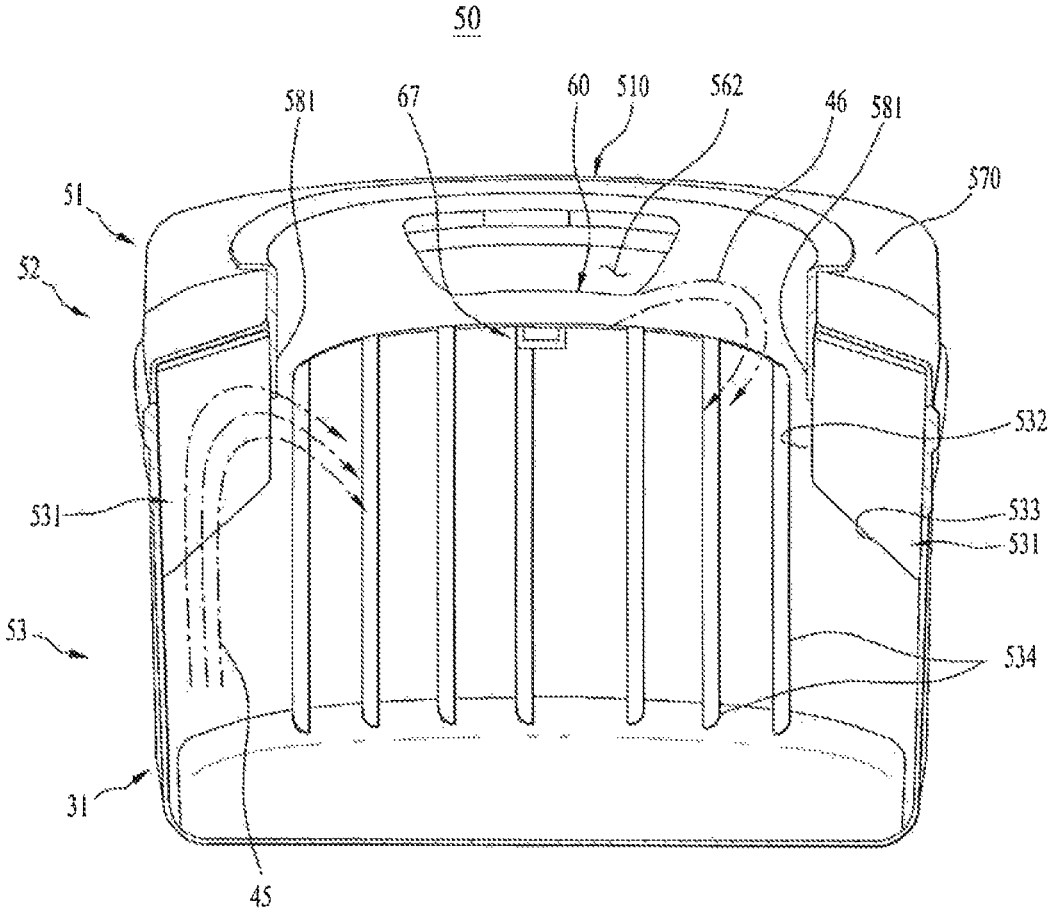
FIG. 4 is a sectional diagram along the line A-A which is shown in FIG. 2.
Figure 5:
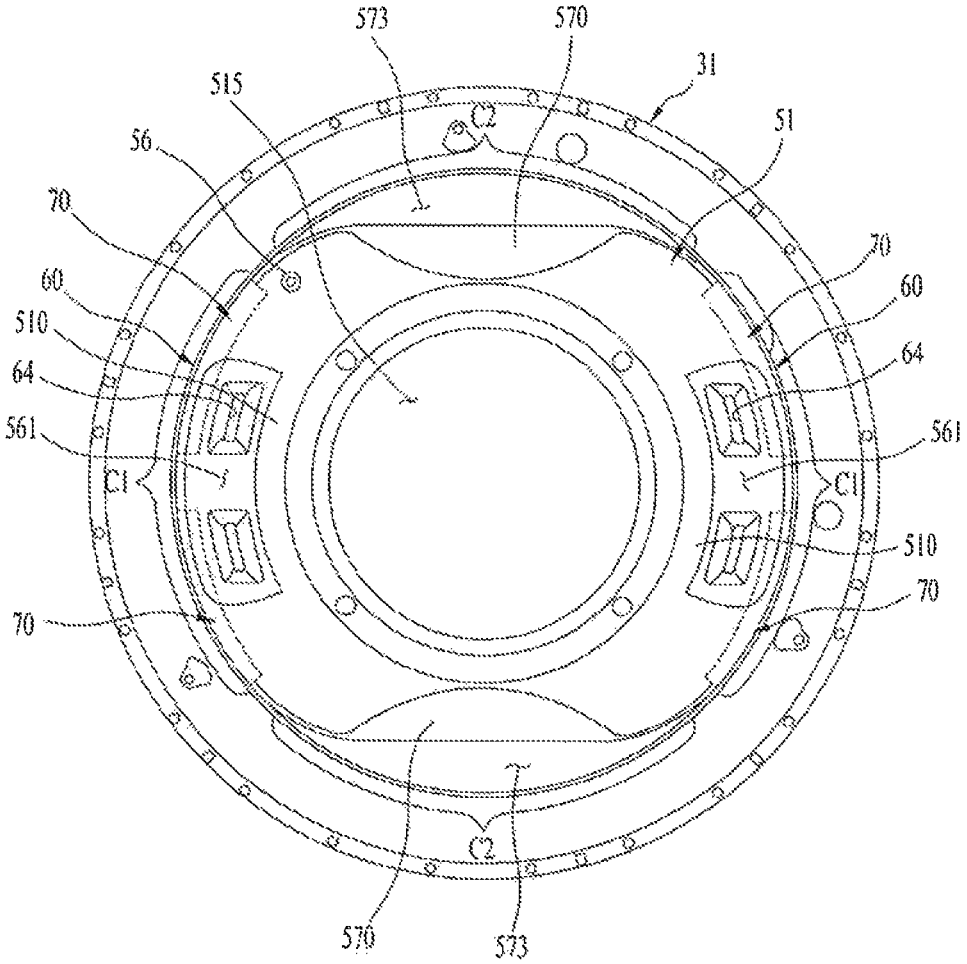
FIG. 5 is a plane view illustrating the sub-drum mounted in a drum.

It is shown in FIGS. 4 and 5 that the cross sectional surface of the sub-drum 50 is oval with respect to the overall height. However, the embodiments are not limited thereto, As one example, one short distance area (C2) may be formed or the short distance area (C2) may be formed only in the sub-drum body 53. In other words, the overall shape of the sub-drum cover 51 is circular and only the sub-drum body 53 provided in the lower area of the sub-drum cover 51 to hold wash water may have the short distance area (C2). Such short distance area may define some space that vertically penetrates the drum from the drum upper portion into the drum interior. Accordingly, it is possible to form a penetrating area (not shown) in the sub-drum cover 51, corresponding to the short distance area.

Accordingly, as mentioned above, it is not necessary to form the overall shape of the sub-drum 50 in the oval shape so as to supply the wash water to the inside of the drum by vertically dropping the wash water via the water supply unit 18, without passing through the sub-drum 50. Any shapes are possible only if the short distance area for allowing the wash water to vertically flow is formed in the sub-drum cover 51. The control of the drum rotation angle may be performed to locate such short distance area to a corresponding area to the water supply unit 18.

Meanwhile, the sub-drum body 53 may include no through-holes 33 formed in the circumferential surface, different from the drum 30 including the through-holes 33 formed in the circumferential surface. Accordingly, the sub-drum body 53 may hold the wash water and the laundry and the wash water may not be exhausted into the drum 30 via the circumferential surface or lower surface. The wash water held in the tub 20 is only drawn into the drum 30 via the through-holes 33, not into the sub-drum 50.

The friction rib 534 may be projected from the inner circumferential surface of the sub-drum body 53 vertically, A plurality of friction ribs 534 may be spaced a preset distance apart from each other and integrally formed with the sub-drum body 53. The friction ribs 534 may be configured to rotate the wash water in the rotational direction of the sub-drum body 53 by frictional force with the wash water during the rotation of the sub-drum body 53. The friction ribs 534 are different from guide ribs 531, which will be described later, in the shape and functions.

The sub-drum cover 51 is coupled to an upper end of the sub-drum body 53, and may have a cross sectional surface which is similar to the cross sectional surface of the sub-drum body 53.

Accordingly, the circumferential surface of the sub-drum cover 51 may be divided into a first curvature area (C1) and a second curvature area (C2). The first curvature area (C1) may be named a first long distance area (C1) and the second curvature area (C2) may be named a second short distance area (C2). Different from the first and second curvature areas (C1) and (C2) of the sub-drum body 53, the first curvature area (C1) of the sub-drum cover 51 is coupled to the inner circumferential surface of the drum cover 31 and may be named a distant area. Also, the second curvature area (C2) of the sub-drum cover 51 is spaced apart from the inner circumferential surface of the drum cover 31 and may then be named a distant area.

The sub-drum cover 51 may include a laundry introduction opening 580 formed in an upper surface to introduce the laundry; and a handle unit 510 which provides a predetermined space to be grabbed by the user.

In addition, the sub-drum cover 51 may include an inner water supply guide 560 configured to guide the wash water exhausted from the water supply unit 18 into the sub-drum 50; and an outer water supply guide 570 configured to guide the wash water exhausted from the water supply unit into the drum 30 along an outer surface of the sub-drum 50.

The inner water supply guide 560 may function to guide the wash water supplied via the water supply unit 18 into the sub-drum smoothly, not into the drum simultaneously.

The outer water supply guide 570 may function to guide the wash water supplied via the water supply unit 18 into the drum smoothly, not into the sub-drum simultaneously.

The sub-drum cover 51 includes a guide rib 531 provided to lift the wash water circulating along the inner circumferential surface of the sub-drum body 53 after the flow direction is changed by collision and fall to the center of the sub-drum body 53.

The handle unit 510 may be formed in an upper surface of the sub-drum cover 51 and include a pair of handle units 510 facing each other.

The handle unit 510 may be arranged adjacent to the first curvature area (C1), in other words, the long distance area (C1) of the sub-drum cover 51. When the wash water is one-sided by the shock applied when the user demounts the sub-drum 50 from the drum 30, rolling might occur in a left-and--right direction while the sub-drum 50 is rotating on a virtual axis passing the pair of the long distance areas (C1). When the handle unit 510 is provided near the second curvature area (C2), in other words, the short distance area (C2), the user has to apply a strong force so as to steady the vertical vibration of the sub-drum 50 such that it may be more advantageous to locate the handle unit 510 near the long distance area (C1).

The inner water supply guide 560 is provided in an upper surface of the sub-drum cover 51, more specifically, the long distance area (C1), in other words, a coupling area (C1). The inner water supply guide 560 may include a concave area 561 and a water supply hole 562.

To form the concave area 561, some area is recessed from the upper surface of the sub-drum cover 51 not to spread the wash water exhausted from the water supply unit 18 around after being collided against the upper surface of the sub-drum cover 51.

The water supply hole 562 is formed in an inner surface of the concave area toward the laundry introduction opening 580 to communicate the concave area 561 with the laundry introduction opening 580. Accordingly, as the wash water is guided to the laundry introduction opening 580 via the water supply hole 562 from the concave area 561, the water supply hole 562 may form a second water supply path 562 to guide the wash water to the sub-drum 50.

The wash water exhausted from the water supply unit 18 is temporarily stored in the concave area 561 such that the wash water may not be spread around the sub-drum cover 51 and then exhausted to the laundry introduction opening 580 via the water supply hole 562, in other words, the second water supply path 562 to be guided into the sub-drum 50.

Meanwhile, the concave area 561 and the water supply hole 562 may be formed in a lower area of the handle units 510 such that the spatial efficiency of the sub-drum cover 51 can be maximized.

The outer water supply guide 570 may be provided in the sub-drum cover 51, preferably, the short distance area (C2), in other words, the distant area (C2). More specifically, the outer water supply guide 570 may be spaced apart from the inner water supply guide 560. The sub-drum 50 may be rotated a preset angle together with the drum 30, to locate the inner water supply guide 560 and the outer water supply guide 570 under one water supply unit 18. Accordingly, even when the outer water supply guide 570 is separated from the inner water supply guide 560, the wash water exhausted from one water supply unit 18 may be supplied to the drum 30 and the sub-drum 50, respectively.

The outer water supply guide 570 is formed by recessing a corner of the distance area (C2) into the sub-drum cover 51 and a bottom surface is inclined outwards and downwards with respect to the sub-drum cover 51. The wash water exhausted from the water supply unit 18 may be guided into the drum 30 along the first water supply path 573 defined as the space formed between the distant area (C2) and the outer circumferential surface of the drum 30.

The guide rib 531 may be formed in a plate shape and provided under the upper surface of the sub-drum cover 51, being extended downwards. The guide rib 531 has one surface contacting with the inner circumferential surface of the sub-drum body 53. More specifically, the plate-shaped guide rib 531 has its top coupled to the sub-drum cover 51 and one side surface in contact with the inner circumferential surface of the sub-drum body 53. Accordingly, the wash water held in the sub-drum body 53 is rotated along the inner circumferential surface of the sub-drum body 53 by the rotational force of the sub-drum 50 and the flow direction of the wash water is changed by the collision with the guide rib 531 to flow upwards and fall down to the center of the sub-drum 50 in an arc.

More specifically, the guide rib 531 may be formed in one surface toward the side surface toward the center of the sub-drum body 53. The guide rib 531 may include a rib vertical area 532 downwardly extended from the upper surface of the sub-drum cover 51; and a rib inclined area 533 formed in a lower surface toward the bottom of the sub-drum body 53, downwardly extended from the rib vertical area and the center of the sub-drum 50 toward the inner circumferential surface.

The rib inclined area 533 is spaced apart from the lower surface of the sub-drum body 53, while forming an acute angle with the inner circumferential surface of the sub-drum 50.

As the rib inclined area 533 is formed in the lower surface of the guide rib 531, the laundry rotated and flowing in the inside of the sub-drum body 53, together with the wash water, may be less interfered with. Accordingly, the flow of the laundry may be performed more efficiently and the friction between the laundry items may be increased enough to enhance the washing efficiency or performance.

Meanwhile, even if the rib inclined area 533 is formed in the guide rib 531, a sufficient amount of wash water can be lifted, For example, when the sub-drum 50 is rotated at a high speed, a water level of the wash water held in the inner circumferential surface of the sub-drum body 53 is higher than a water level of the wash water held in the center of the sub-drum body 53. Accordingly, even if the rib inclined area 533 is formed in the guide rib 531, sufficient wash water can be collided with the guide rib 531 to be lifted.

Meanwhile, when the sub-drum 50 is rotated at a relatively low speed, the guide rib 531 may be arranged in the short distance area (C2) of the sub-drum cover 51 to lift a sufficient amount of wash water. The amount of the wash water passing through a virtual section from the center of the sub-drum body 53 to the short distance area (C2) is equal to the amount of the wash water passing through a virtual section from the center of the sub-drum body 53 to the long distance area (C1). Accordingly, the water level of the wash water when passing through the virtual section to the short distance area (C2) from the center of the sub-drum body 53 is higher than the water level of the wash water when passing through the virtual section to the long distance area (C1) such that the guide rib 531 can lift the sufficient amount of the wash water even when the sub-drum 50 is rotated at the low speed.

The guide rib 531 has one surface configured to collide with the wash water and the other opposite surface, which are upwardly inclined toward the flow direction of the wash water. In other words, when viewing the guide rib 531 from the center of the sub-drum body 53 in a radial direction, the width of the lower cross section may be larger than the width of the upper cross section. Accordingly, the wash water may be lifted along the one surface and the other surface of the guide rib 531 more efficiently.

By experiments, it may be shown that high washing efficiency is generated together with an inclined guide, when the horizontal length and the height of the sub-drum 50 is 399 mm and 309.2 mm and the height (H) and the width (W) of the guide rib 531 are 70 mm and 65 mm. When the experiment is performed in a state the height (H) of the guide rib 531 is set as 50 mm and 90 mm with the other values are the same, more enhanced washing performance is gained for some contaminants but an average of the values is lower than an average when the height (H) of the guide rib 531 is set as 70 mm, meanwhile, such values are just one example gained by the experiments and specific values of the sub-drum 50 and the guide rib 531 are not limited thereto.

Thee pair of the guide ribs 531 is provided in the short distance area (C2), respectively, as mentioned above, and the embodiments are not limited thereto. More guide ribs 531 are provided in the long distance area (C1) to be two pairs.

The inclined guide 581 may be provided above the guide rib 531 and downwardly inclined to the inside of the sub-drum 50. More specifically, the inclined guide 581 is formed along an inner area, in other words, an inner circumferential surface of the laundry introduction opening 580 provided above the guide rib 531.

Without the inclined guide 581, the wash water lifted by the guide rib 531 flows to an upper area of the inner circumferential surface of the sub-drum body 53 and then a lower area of the upper surface toward the center of the sub-drum body 53. After that, the wash water falls into the sub-drum body 53 freely, while drawing an arc.

When the inclined guide 581 is installed, the wash water will not fall freely. In other words, the wash water horizontally flowing along the lower area of the upper surface of the sub-drum cover 51 may form the flow 45 of which a direction is drastically changed downwards by the lower surface of the inclined guide 581. More specifically, the horizontal component speed is partially changed into the vertical component speed. The wash water of which the flow direction is drastically changed is collided against the laundry loaded in the sub-drum body 53 more strongly than the wash water falling down freely. At this time, the inclination angle (θ) of the inclined guide 581 may be set as approximately 10 degrees with respect to the direction of gravity. The angle at which the flow direction of the wash water is changed may be set larger. Accordingly, a stronger shock may be applied to the laundry loaded in the sub-drum body to enhance the washing performance.

It is described that the inclination angle (θ) is approximately 10 degrees and such value is one of examples, not limited thereto.

Meanwhile, when the sub-drum 50 is rotated at a high speed, the wash water held in the sub-drum 50 could collide with each other to splash to the laundry introduction opening 580. At this time, the inclined guide 581 is configured to guide the splashed wash water into the sub-drum 50 along the upper surface so as to form the flow 46 to the sub-drum 50.

The sub-drum 50 has a second uneven area 535 formed in an outer circumferential surface to be seated on an inner circumferential surface of a balancer 311 while engaging with the first uneven portion 312 formed in the balancer 311. Such second uneven area 535 may be formed in the coupling area (C1) of the outer circumferential surface of the sub-drum body 53. It is preferred that the second uneven area 535 is not formed in the outer circumferential surface of the sub-drum cover 51. The wash water held in the sub-drum body 53 and the weight of the laundry might separate the sub-drum cover 51 from the sub-drum body 53.

The first uneven area 312 is projected from the inner circumferential surface of the drum cover 31. In addition, projections are upwardly projected from an upper end of the first uneven area 312. The first uneven area 312 is formed over the circumference of the inner circumferential surface of the drum cover 31.

The second uneven area 535 is projected from the outer circumferential surface of the sub-drum. The outer circumferential surface of the sub-drum is divided into a short distance area C2 and a long distance area C1. The long distance area may be coupled to the inner circumferential surface of the drum cover such that the second uneven area 535 may be formed in the long distance area. Projections are continuously and downwardly projected from a lower end of the second uneven area 535. The projections of the second uneven area 535 are configured to engage with the projections of the first uneven area 312.

Accordingly, the rotational force of the drum 30 may be transferred to the sub-drum 50 and the sub-drum 50 may be also rotated together with the drum 30. Meanwhile, the sub-drum 50 includes a discharging area 70 for discharging the water from the sub-drum 50 while the sub-drum 50 is rotated at a high rotation speed. The discharging area 70 is projected adjacent to a first curvature C1, in other words, the long distance area C1 and performs a function of selectively discharging the wash water held in the sub-drum 50 outside by the size of the centrifugal force generated during the rotation of the sub-drum 50.

As described above, the washing process performed by the sub-drum 50 is independently separated from the washing process performed by the drum 30. For that, water supply to the drum 30 has to be separated from water supply to the sub-drum 50. Moreover, the wash water supplied to the sub-drum 50 has to be held in the sub-drum 50 prevent the water from flowing into the drum 30 and the water has to be discharged from the sub-drum 50 in a drainage process and a dry-spinning process.

In other words, the sub-drum 50 has to hold wash water when rotated at a washing rpm to perform the washing and discharge the water when rotated at a dry-spinning rpm which is higher than the washing rpm.

At this time, the discharging area 70 is configured to discharge the water outside only when the centrifugal force generated by the rotation of the sub-drum 50 at the dry-spinning rpm higher than the washing rpm.

Such discharging area 70 may have a chamber (not shown) which accommodates water; an inlet hole (not shown) provided to draw water; and an outlet hole 79 provided to discharge the water from the chamber.

The discharging area 70 may be spaced a preset distance from a lateral wall of the sub-drum 50 in an inner radial direction, while the inlet hole is provided in a bottom surface of the chamber. Accordingly, the entire area of the inlet hole is smaller than the area of the chamber bottom surface with which the water is collided and a first resistance is generated when the water is drawn via the inlet hole. After that, a second resistance is additionally generated to raise the water against the centrifugal force, after flowing outside with respect to a radial direction.

Moreover, the discharging area 70 has the outlet hole 791 provided above the inlet hole and penetrating the lateral wall of the sub-drum 50. Accordingly, when water is drawn into the chamber via the inlet hole, a third resistance is additionally generated to flow outside the radial direction of the sub-drum 50 and then to raise the water against the gravity.

Accordingly, when the sub-drum 50 is rotated at the washing rpm which is lower than the dry-spinning rpm, the wash Water may not be discharged from the sub-drum 50. In other words, the wash water is set to be selectively discharged only when the sub-drum 50 is rotated at preset dry-spinning rpm. Of course, such selective discharging may be facilitated even without the configurations including a drainage valve or a drainage pump provided as control objects.

Meanwhile, the sub-drum 50 may include a body 53 configured to hold water and laundry; and a sub-cover coupled to an upper surface of the body 53 and having a laundry introduction opening 515 for loading the laundry.

In this instance, the second uneven area 535 is provided in an outer circumferential surface of the body 53 so as to prevent the sub-cover from being separated from the body 53 by the weight of the water and laundry loaded in the body 53. In addition, the discharging area 70, the guide rib 531, the handle unit 510, the inner water supply guide 560 and the outer water supply guide 570 may be also provided in the sub-cover.

Meanwhile, the sub-cover may be integrally formed as one body. Alternatively, as shown in FIG. 3, the sub-cover may include a lower cover 52 coupled to the upper end of the body 53; and an upper cover 51 coupled to a top of the lower cover 52.

The chamber (not shown) of the discharging area 70 is defined by the coupling between the lower cover 52 and the upper cover 51. In this instance, the inlet hole is provided in the lower cover 52. The outlet hole 79 may include a first outlet hole 791 provided in an upper end of the lower cover 52; and a second outlet hole 792 provided in an upper end of the upper cover 51. Accordingly, after water is drawn into the chamber via the inlet hole, the water is discharged via the outlet hole 79 configured of the second outlet hole 792 and the first outlet hole 791.

The concave area 561 forming the inner water supply guide 560 may be defined by the coupling between the lower cover 52 and the upper cover 51. An upper surface of the lower cover 52 may form a bottom surface of the concave area 561 and some inserted area of the upper cover 51 may form an inclined surface of the concave area 561. The water supply hole 562 forming the inner water supply guide 560 may be defined by the space distance from the handle unit 510 and the upper surface of the lower cover 52.

Meanwhile, a control method of the laundry treating apparatus 1 in accordance with one embodiment may determine whether the sub-drum 50 is mounted in the drum 30 before starting the washing or performing the water supply for the washing. Also, the control method may determine whether the sub-drum is mounted normally and it may be performed by using the first sensor unit 54.

In this instance, the control unit 100 performs preset determination processes based on the sensing signal transmitted from the first sensor unit 54 and the second sensor unit 25 or the sensing signal transmitted from the first sensor unit 54 and the output currents detected while predetermined frequency currents are flowing to the motor and control the water supply unit 18. the drive unit 14 and the brake unit 110 based on the result of the determination processes. The sensing signal transmitted from the second sensor unit 25 and the output currents detected while the preset frequency currents are flowing to the motor are used when the control unit 100 measures the rotation angle of the drum 30. Hereinafter, for easy and convenient description, the second sensor unit 25 is exemplified as the element configured to sense the rotation angle of the drum. Detailed description about the relation between the elements for the water supply will be omitted.

Meanwhile, the embodiment for the location control of the drum 30 and the sub-drum 50 to supply wash water is described. However, the location control of the drum 30 and the sub-drum 50 for the location control of the handle units 510 may be performed.

The user is able to separate the sub-drum 50 from the drum 30 while holding the handle units 510. Accordingly, it is preferred that the handle units 510 are configured to allow the user to easily grab the handle units 510 from the surface of the laundry treating apparatus. The location control of the drum 30 may be performed to locate the handle units 510 at a desired position.

More specifically, the location control of the sub-drum 50 may be performed at a place where the sub-drum 50 is decoupled. As one example, the location control may be performed to pause or end the washing course.

When the sub-drum 50 is mounted in the drum 30 only at a specific location, the location control of the drum may be performed for an easy coupling process. As one example, the location control may be performed to pause the washing without the sub-drum 50 or start and end the washing without the sub-drum 50.

In other words, the rotation location control of the drum 30 and/or sub-drum 50 (the stopping of the drum 30 and/or sub-drum 50 at a preset location) may be performed for the water supply and for easy and convenient mounting and/or demounting of the sub-drum.

Meanwhile, the laundry treating apparatus may be configured to perform one or more washing courses and may include an auxiliary control panel configured to allow the user to select the washing courses. The control panel may include an input unit configured to receive various washing course inputs and a display unit configured to display the input washing courses.

On such a control panel, there may be provided the washing courses for the laundry loaded in the drum 30 and no washing courses for the laundry loaded in the sub-drum drum 50. In this instance, once the sub-drum 50 is mounted, the laundry treating apparatus 1 may determine and implement a corresponding washing course to the sub-drum 50 out of the preset washing courses.

Accordingly, when trying to use the sub-drum 50 after mounting the sub-drum 50 in the conventional laundry treating apparatus 1 having no sub-drum 50, the user is able to use the control panel of the conventional laundry treating apparatus without change or fixing.

Figure 7:
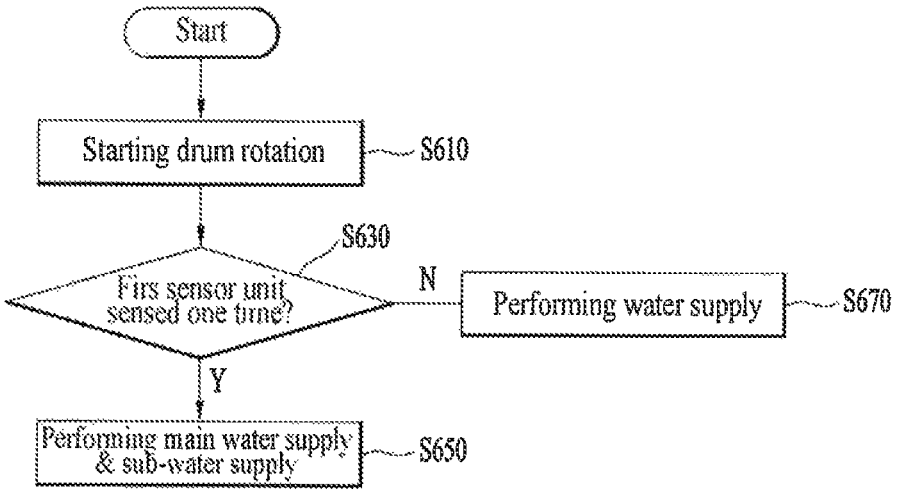
FIG. 7 is a flow chart illustrating a step for determining whether the sub-drum is mounted in the drum.

Referring to FIG. 7, the control method in accordance with one embodiment will be described in detail.

It has to be determined whether the washing course is performed only in the drum 30 or the sub-drum 50. For that, the drum is rotated (S610) and the drum is rotated to determine whether the sub-drum 50 is mounted or whether the sub-drum 50 is mounted properly (e.g., normally or abnormally). It can be said that such determination is performed to determine whether to supply wash water only to the drum 30 or both of the drum 30 and the sub-drum 50.

More specifically, the control unit 100 is implemented to control the drive unit 14 to rotate the drum 30. When the drum 30 is rotated, the second sensor unit 25 senses the rotation angle of the drum 30 and transmits a signal to the control unit 100.

Meanwhile, when a normal signal is not received from the first sensor unit, it may be determined that the sub-drum is not mounted or that the sub-drum is mounted abnormally. As one example, when receiving no signal from the first sensor unit 54 while the second sensor unit 25 senses that the rotation angle of the drum 30 is 360 degrees, the control unit 100 may determine that the sub-drum 50 is not mounted in the drum 30 (S630-N).

When determining that the sub-drum 50 is not mounted in the drum 30, the control unit 100 is implemented to control the water supply unit 18 to supply wash water to the drum 30 (S670). In this instance, the location control of the drum for the water supply may not be performed. In other words, the control unit 100 may not control the drive unit 14 and the brake unit 110 to locate the outer water supply guide 570 or the inner water supply guide 560 under the water supply unit.

When it is determined that the sub-drum 50 is mounted abnormally, an alarm may be provided.

Meanwhile, when a normal signal is received from the first sensor unit, it may be determined that the sub-drum is mounted normally. As one example, when receiving the signal from the first sensor unit 54 while the second sensor unit 25 senses that the rotation angle of the drum 30 is 360 degrees, the control unit 100 may determine that the sub-drum 50 is mounted in the drum 30 (S630-Y).

Once determining that the sub-drum 50 is mounted in the drum 30 normally, the control unit 100 is implemented to perform the location control of the sub-drum 50 so as to supply wash water.

As one example, the control unit performs a main water supply to the drum 30 by locating the outer water supply guide 570 under the water supply unit 18. The control unit 100 may perform a sub-water supply configured to rotate the sub-drum 50 a preset angle and then locate the main water supply and the inner water supply guide 560 under the water supply unit 18 (S650). Of course, the main-water supply may be performed after the sub-water supply.

Once the water supply starts, wash water is exhausted via the water supply unit 18. The exhausted wash water is supplied to the sub-drum 50 via the water supply guide 560 and to the drum 30, in other words, the tub 20 via the outer water supply guide 570. In other words, the water supply is performed after the angle control is performed configured to locate the inner water supply guide 560 and the outer water supply guide 570 under the water supply unit 18 by rotating the sub-drum 50.

For example, the control unit 100 may control the drive unit 14 to rotate the sub-drum 50 at a low rpm for the water supply. In this instance, the rpm is set as '3'. When the first sensor unit 54 transmits a sensing, signal to the control unit 100, the control unit 100 may rotate the sub-drum 50 a preset angle from the moment when the first sensor unit 54 sends the sensing signal and locate the outer water supply guide 570 under the water supply unit 18. Such a rotation angle is preset according to the arrangement relation among the first sensor unit 54, the outer water supply guide 570 and the water supply unit 18.

The rotation angle of the sub-drum 50 is measured by the second sensor unit 25 and transmitted to the control unit 100, while the sub-drum 50 is rotated at a very low rpm. The control unit 100 controls the brake unit 110 to stop the sub-drum once determining that the measured rotation angle reaches a preset rotation angle.

As the rpm of the sub-drum 50 is very low, the distance of the sliding of sub-drum 50 from the point when the brake unit 110 starts is so small as to be ignored. When the sub-drum 50 is stopped by the brake unit 110, the outer water supply guide 570 is almost located under the water supply unit 18, Accordingly, the wash water exhausted from the water supply unit 18 may be supplied to the drum 30 via the outer water supply guide 570, without correcting the location of the sub-drum 50.

Meanwhile, as the rpm of the sub-drum 50 is very low, the control unit 100 may cut off the currents flowing to the drive unit from the point or in a preset time period when the first sensor unit 54 senses the location of the sub-drum 50, At this time, the sub-drum 50 may be moving by inertia. However, the angle of the rotation caused by the inertia at low rpm may be so small as to be ignored or expected from the current cut-off point. The stopping location of the sub-drum may be expected at the current cut-off point based on the rpm and the location of the sub-drum at the sensing point of the first sensor unit. The location control of the sub-drum 50 may become simpler on the assumption that there is no large error of the expected location.

The braking caused by the rotation of the sub-drum 50 to supply wash water via the inner water supply guide 560 is equal to the braking caused by the rotation of the sub-drum 50 to supply wash water via the outer water supply guide 570 mentioned above, such that detailed description thereof can be omitted.

Meanwhile, as another example for the precise location control of the sub-drum 50, the control unit 100 may control the drive unit 14 to slidingly move the sub-drum 50 from the point when the brake is applied to the sub-drum by raising the rpm of the sub-drum 50. In this instance, the rpm may be set as '15~25' and the embodiments are not limited thereto.

In this embodiment, the rotation angle to locate the outer water supply guide 570 under the water supply unit 18 when the first sensor unit 54 transmits a sensing signal may be also preset according to the arrangement relation among the first sensor unit 54, the outer water supply guide 570 and the water supply unit 18. However, in the preset rotation angle of this embodiment may be set to be the same value with the preset rotation angle in the above-noted embodiment. Considering the sliding distance of the sub-drum, the preset rotation angle of this embodiment may be smaller than that of the above-noted embodiment.

Similar to the above-noted embodiment, the rotation angle of the sub-drum 50 is measured during the rotation of the sub-drum and the measured values may be transmitted to the control unit 100. Once determining that the measured rotation angle reaches a preset rotation angle, the control unit 100 controls the brake unit 110 to stop the sub-drum 50.

The sub-drum 50 has variable sliding angles at which the sub-drum 50 slides from the brake start point by the wash water held therein and the weight of the laundry. Especially, when the rpm is relatively high, such a sliding angle may vary. When the second sensor unit 25 measures the sliding angle of the sub-drum 50 and transmits the measured angle to the control unit 100, the control unit 100 corrects the preset rotation angle. For example, the control unit corrects the preset rotation angle to be smaller when the sliding angle of the sub-drum 50 is large enough for the outer water supply guide 570 to pass by the lower area of the water supply unit 18. In vice versa, the control unit 100 corrects the preset rotation angle value to be larger. At this time, the rpm is 15~25 rpm which are higher than 3 rpm and lower than 40~49 rpm in the conventional washing such that little load may be applied to the drive unit 14. Accordingly, the overload of the drive unit may be prevented and the precise location control of the sub-drum may be facilitated. In other words, after the correcting process is performed to prevent a deviation or an error, the location control of the sub-drum is performed and the precise location control of the sub-drum may be then performed.

Meanwhile, after water is supplied to the drum 30 and the sub-drum 50, the drive unit 14 is implemented to rotate the drum 30 and the sub-drum 50 and perform the washing process.

In case of washing the laundry loaded in the drum 30, washing may be performed through various drum drive motions. According to one embodiment of the present invention, a basket motion and a pulsator motion may be implemented to wash the laundry loaded in the drum 30. The basket motion is one motion implemented to rotate only the drum and the pulsator motion is one motion implemented to rotate only the pulsator so as to form water currents in the drum. Accordingly, the washing may be substantially performed in the pulsator motion. Of course, the washing may be performed with combinations of various motions including such motions.

Control factors including a combination pattern of motions, a duration of a motion and RPM may be set different according to the selected course. Such control factors may be changed based on information about not only the course but also the options selected by the user. As one example, control factors in the substantially performed course may be changed according to option information such as a contamination level, a water temperature, a dry-spinning RPM, a rinsing frequency and a wash water level.

Accordingly, control factors for washing may be selectable by the user and the selection may be facilitated through various user interfaces that are provided in the control panel. The user interfaces may be configured to perform the washing for the drum 30.

However, when the sub-drum 50 is mounted in the drum 30 to perform washing, it is preferred that diverse washing courses are provided to perform washing for the sub-drum 50. As one example, a special course for lingerie or delicate clothing needs to be performed in the sub-drum 50 or another special course for cleaning tools with severe contamination needs to be performed in the sub-drum 50.

In the basket motion, the drum is rotated and thus the sub-drum 50 is also integrally rotated with the drum. Accordingly, it is possible to realize a plurality of courses for the sub-drum 50 by changing the duration or RPM of the basket motion.

In other words, it is possible to perform a specific course for the sub-drum simultaneously or combinedly together with a specific course for the drum. However, in this instance, it is not easy to further provide an auxiliary user interface in the control panel to select a course for the sub-drum or a corresponding option to the selected course.

Figure 8:
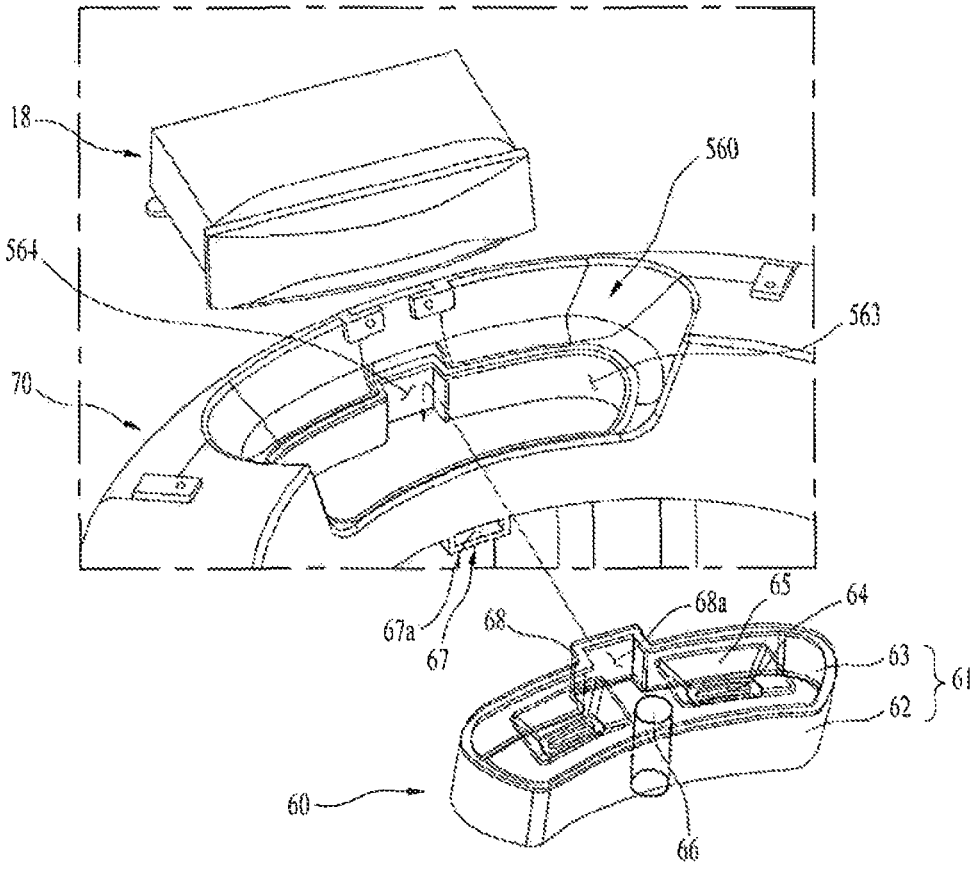
FIG. 8 is a perspective diagram illustrating one embodiment of a detergent box mounted in the sub-drum shown in FIG. 1.

Hereinafter, referring to FIGS. 8 and 9, a detergent box 60 according to one embodiment will be described in detail. FIG. 8 is a perspective diagram illustrating one embodiment of a detergent box 60 mounted in the sub-drum shown in FIG. 1 and FIG. 9 is a side sectional diagram to describe the detergent box 60 of FIG. 8;

The detergent box 60 is provided in the sub-drum to accommodate a detergent as described above and configured to discharge the accommodated detergent to the sub-drum 50. The detergent box 60 is supplied wash water from the water supply unit 18 to discharge the accommodated detergent and discharges the detergent, together with the supplied wash water, by using a siphon effect.

The detergent may include a washing detergent and a fabric softener. The washing detergent may include a solid detergent and a liquid detergent. The fabric softener may include a liquid softener. The siphon effect may be configured to supply the liquid softener or the liquid detergent to the inside of the sub-drum. In some embodiments, the solid detergent is dissolved in the wash water and supplied to the inside of the sub-drum, mixedly together with the wash water.

Figure 9:
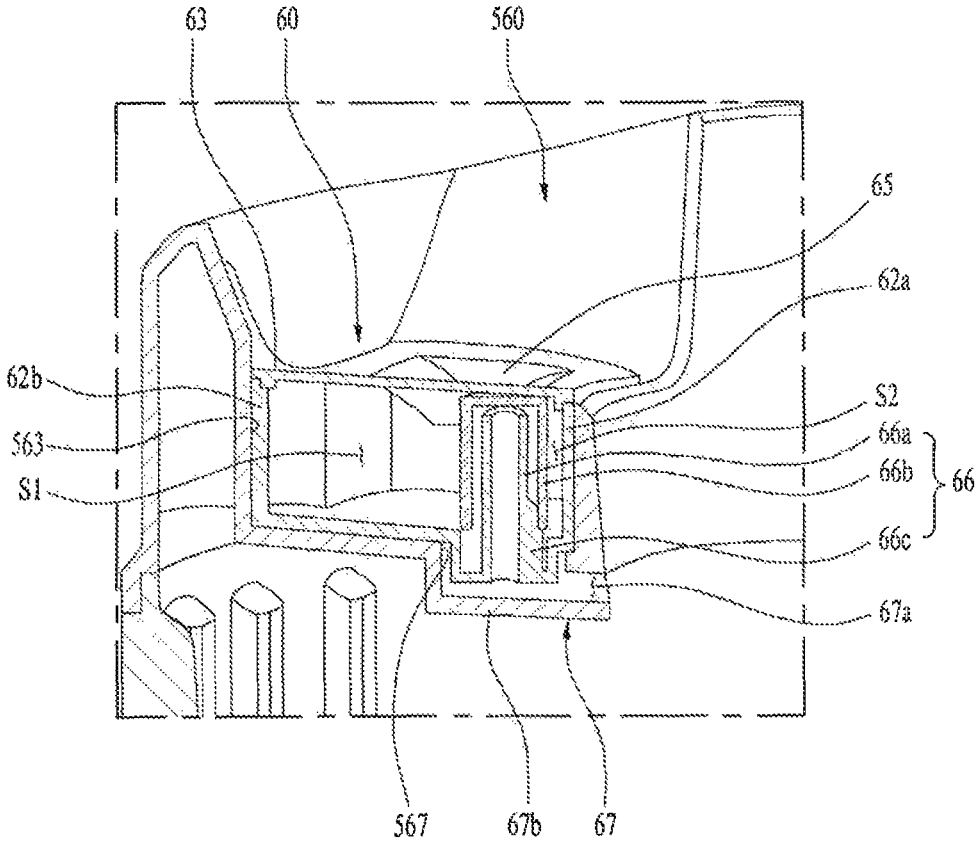
FIG. 9 is a side sectional diagram to describe the detergent box of FIG. 8.

Referring to FIGS. 8 and 9, the detergent box 60 may be provided in a lower surface of the inner water supply guide 560, in other words, a lower surface of the recessed area 561 to be supplied with wash water from the water supply unit 18. Specifically, a holding area 563 is provided in the lower surface of the recessed area 561 and the detergent box 60 may be kept in the holding area 563 in a state of being retractable upwardly. Once wash water is discharged from the water supply unit 18, some of the wash water passes through a water supply hole 562 along the recessed area 561 to be supplied to the sub-drum 50 and the other wash water may be drawn into the detergent box 60 provided in the lower surface of the recessed area 561.

To draw in the wash water, the detergent box 60 includes an inlet provided in an upper surface and configured to draw in wash water. The detergent may be loaded in the detergent box 60 via the inlet. The inlet may be referred to as a detergent inlet 64. The detergent inlet 64 may penetrate the upper surface of the detergent box 60 and include an inlet inclined area 65 inclined towards the detergent inlet 64 from a neighboring area of the detergent inlet 64 to draw the detergent smoothly. Moreover, a plurality of detergent inlets 64 may be provided in the upper surface of the detergent box 60.

The detergent box 60 may include an inner wall 62*a* provided to accommodate the supplied detergent; an outer wall spaced apart from the center of the sub-drum 50 in a direction of increasing distance from the center of the sub-drum; and a detergent accommodating space formed between the inner wall 62*a* and the outer wall 62*b* and configured to accommodate the detergent. In this instance, a pair of lateral walls facing each other may be provided between the inner wall 62*a* and the outer wall 62*b*. However, both ends of the inner wail and the outer wall 62*b* contact with each other such that the lateral walls may not be provided.

The detergent box 60 may include a detergent discharging unit 66 configured to discharge the detergent together with the wash water supplied from the water supply unit 18 according to the siphon effect. The detergent discharging unit 66 may include a siphon pipe 66*a;* a siphon cap 66*b;* and a rib 66*c* for keeping a distance.

The siphon pipe 66*a* is provided in the lower surface of the detergent box 60 and formed in a cylindrical shape in which a path is formed to facilitate communication between the inside of the detergent box 60 and the inside of the sub-drum 50.

The siphon cap 66*b* is formed to cover the siphon pipe 66*a* to form a siphon path. The siphon cap 66*b* may be spaced a preset distance from an outer circumferential surface and an upper end of the siphon pipe 66*a*.

The distance keeping rib 66*c* may be configured to space the outer circumferential surface of the siphon pipe 66*a* a preset distance apart from an inner circumferential surface of the siphon cap 66*b*. For that, a plurality of distance keeping ribs 66*c* may be provided in the outer circumferential surface of the siphon pipe 66*a* in a radial direction to seat the siphon cap 66*b* on the outer circumferential surface. The distance keeping ribs may be sloped.

Once wash water is supplied to the detergent box 60 having the above-noted configuration, the detergent becomes dissolved and a water level rises in the detergent box 60. If the water level reaches a reference level or more, the wash water and the detergent start to be discharged via the siphon pipe 66*a* along the siphon path formed between the siphon pipe 66*a* and the siphon cap 66*b*. The wash water is continuously discharged via the siphon pipe 66*a* until the water level becomes lower than a lower end of the siphon cap 66*b*. Meanwhile, a detergent display unit may be formed on an outer circumferential surface of the siphon cap 66*b* to display a proper amount of detergent to the user.

Meanwhile, the detergent box 60 accommodating the detergent is rotated together with the sub-drum 50, centrifugal force is generated by the rotation and the accommodated detergent is moved in a direction of increasing distance from the center of the sub-drum 50 to cause a one-sided detergent phenomenon. For example, detergent may be forced to one side of the detergent box 60.

Such one-sided phenomenon might raise the height of the detergent on one side of the detergent box 60 and the siphon effect may be actuated at a different point in time, not the point in time for wash water supply, such that the detergent might be discharged via the detergent discharging unit 66 in a manner not intended. Particularly, the fabric softener which can be loaded during the washing process might be discharged by the rotation of the sub-drum 50 before the final wash water supply is performed.

To address the above, the detergent discharging unit 66 may be one-sided in the reverse direction of a direction in which the detergent accommodated in the detergent box 60 is one-sided by the centrifugal force of the rotating sub-drum 50. For example, the discharging unit 66 may be disposed on a side of the detergent box 60 opposite from a radial outer side of the detergent box 60. Furthermore, the detergent accommodating space may be partitioned off into a first space S1 formed between the detergent discharging unit 66 and the outer wall; and a second space (S2) formed between the detergent discharging unit 66 and the inner wall.

Even if the detergent supplied to the inside of the detergent box 60 is one-sided towards the outer wall by the rotation of the sub-drum 50, the first space (S I) may function as a buffer for temporarily storing a large volume of the accommodated detergent. In other words, even if the detergent is filled in the first space S1 by centrifugal force, the height of the detergent in the first space S1 becomes sufficiently lower from the outer wall towards the detergent discharging unit 66 because of the large volume of the first space S1, only to prevent the siphon effect which might cause one-sidedness of detergent due to the centrifugal force.

Meanwhile, when the detergent box 60 accommodating the detergent is rotated together with the sub-drum 50, the one-sided detergent caused by the centrifugal force might generate the siphon effect. However, the wash water is raised along an inner circumferential surface of the sub-drum 50 by the rotation of the sub-drum 50 and drawn into the siphon pipe 66*a*. A lower cap 67 may be provided under the siphon pipe 66*a* to prevent the siphon effect generated after the rising wash water is drawn into the siphon pipe 66*a*.

The lower cap 67 may be provided under the siphon pipe 66*a* to surround a lower end of the siphon pipe 66*a*. Specifically, the lower cap 67 includes a cap body 67*b* downwardly projected from the lower surface of the holding area 563 and having a path formed therein to flow the wash water therein; and the detergent outlet 67*a* provided in one surface of the cap body 67*b* towards the center of the sub-drum 50. The lower cap 67 may facilitate communication between the path formed by the cap body 67*b* (e.g., the detergent outlet 67*a*) and the inside of the sub-drum 50.

The path formed by the cap body 67*b* may communicate with the inside of the holding area 563 via a lower through-hole 567 penetrating the lower surface of the holding area 563 and it may be extended from the lower through-hole 567 towards the center of the sub-drum 50 to be connected with the detergent outlet 67*a*. Here, the detergent outlet 67*a* is spaced a preset distance from the lateral surface of the sub-drum 50, while oriented towards the center of the sub-drum 50.

Meanwhile, when a lower end of the detergent discharging unit 66 is inserted in the lower through-hole 567, the path formed by the cap body 67*b* is connected with the inside of the siphon pipe 66*a* such that the inside of the siphon pipe 66*a* and the inside of the sub-drum 50 may be in communication.

Accordingly, the lower cap 67 may primarily prevent the wash water rising along the inner circumferential surface of the sub-drum 50 during the rotation of the sub-drum 50 from being directly drawn into the siphon pipe 66*a*, as the inside of the siphon pipe 66*a* is not exposed to the inside of the sub-drum 50.

Moreover, the lower cap 67 may secondarily prevent the rising wash water from being drawn into the siphon pipe 66*a* via the detergent outlet 67*a* after moved towards the center of the sub-drum 50 against the centrifugal force, as the detergent outlet 67*a* is provided towards the center of the sub-drum 50, spaced a preset distance apart from the lateral surfaces of the sub-drum 50.

A guide groove 564 is provided in the holding area 563 to guide the insertion process of the detergent box 60. The detergent box 60 may include a holding guide 68 that may be configured to cooperate with the guide groove 564. The holding guide 68 may be projected from the detergent box 60 so as to be inserted in the guide groove 564. Accordingly, the user is able to detach the detergent box 60 from the holding area 563.

The holding guide 68 of the detergent box 60 may be projected from the outer wall 62*b* provided to locate the first space S1 between the detergent discharging unit 66 and itself in the direction in which the centrifugal force is actuated. Moreover, the holding guide 68 may form the space for accommodating the detergent. Accordingly, the holding guide 68 may be configured to expand the first space S1 and function as a buffering space for temporarily accommodating the wash water or detergent in the first space S1.

Meanwhile, the detergent box 60 may include an accommodation body 62 provided to accommodate the detergent; and a body cover 63 detachably coupled to an upper end of the accommodation body 62.

The body cover 63 may be made of a transparent material to make the inside of the accommodation body 62 visible by the naked eye and may include a detergent inlet 64 and an inlet inclined area 65. In addition, the body cover 63 may include a siphon cap 66*b* downwardly extended.

The accommodation body 62 may include the siphon pipe 66*a* that is upwardly extended and configured to facilitate communication between the outside and the inside of the detergent box 60. Here, the siphon pipe 66*a* may also extend downward more than the lower surface of the accommodation body 62, such that the accommodation body 62 may be inserted in the lower through-hole 567.

As it is provided in the lower surface of the recessed area 561 as described above, the detergent box 60 may be located adjacent to the coupling area and under the handle unit. Moreover, the detergent box 60 may be located closet to the center of the sub-drum 50 than the discharging area 70.

Figure 10:
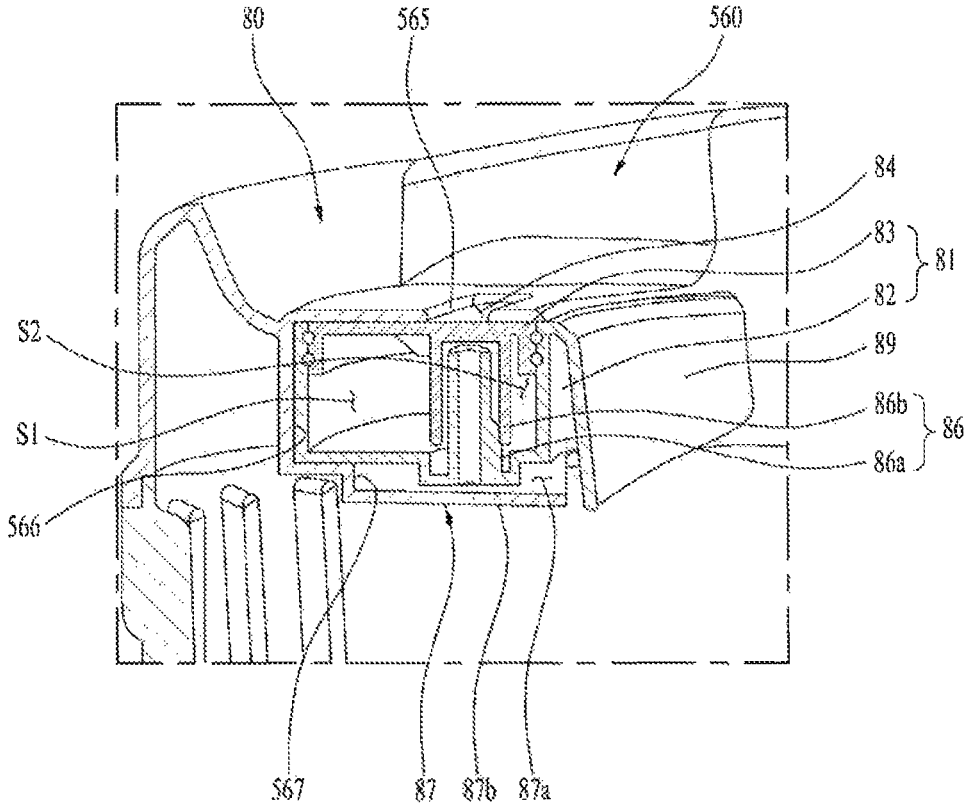
FIG. 10 is a side sectional diagram illustrating another embodiment of the detergent box mounted in the sub-drum shown in FIG. 1.

Referring to FIG. 10, a detergent box 80 according to another embodiment will be described in detail. FIG. 10 is a side sectional diagram illustrating the detergent box 80 according to another embodiment mounted in the sub-drum 50 shown in FIG. 1.

The same numeral references are given to the same structural components according to this embodiment with the components of the holding area 566 provided to hold the detergent box 80 according to the above-noted embodiment and detailed description is omitted accordingly.

Referring to FIG. 10, the detergent box 80 according to this embodiment includes the detergent discharging unit 86 provided to discharge the wash water supplied from the water supply unit 18 and the detergent by using the siphon effect, like the above-noted embodiment. The detergent discharging unit 86 may include a siphon pipe 86*a;* and a distance keeping rib. The detergent discharging unit 86 may be the same as or similar to the detergent discharging unit 66 provided in the detergent box 60 according to the embodiment described above and detailed description thereof is omitted.

Meanwhile, the detergent box 80 may be retractable towards the center of the sub-drum 50, different from the above-noted embodiment. Accordingly, the holding area 566 is provided under the lower surface of the recessed area 561 and an opening for retracting the detergent box 80 is formed towards the center of the sub-drum 50.

A lower through-hole 567 penetrates the lower surface of the holding area 566. A lower end of the detergent discharging unit 86 is inserted in the lower through-hole 567.

The lower cap 87 is provided in a lower area of the lower through-hole 567 to surround a lower end of the siphon pipe 86*a* so as not to expose the lower end of the siphon pipe 86*a* to the inside of the sub-drum 50. Accordingly, the lower through-hole 567 is also not exposed to the inside of the sub-drum 50.

Such lower cap 87 may include a cap body 87*b* downwardly projected from the lower surface of the holding area 566 and having a path formed thereto through white the wash water may flow; and a detergent outlet hole 87*a* provided in one surface of the cap body 87*b* and configured to facilitate communication between the path of the cap body 87*b* and the inside of the sub-drum 50.

The path of the cap body 87*b* may communicate with the inside of the holding area 566 via the lower through-hole 567. When the siphon pipe 86*a* is inserted in the lower through-hole 567, the path of the cap body 87*b* may communicate with the inside of the siphon pipe 86*a*.

An accommodating area handle 89 is provided in an outer surface oriented towards the center of the sub-drum out of the outer surfaces of the detergent box 80 to allow the user to draw the detergent box 80 towards the center of the sub-drum 50 easily. The accommodating area handle 89 is coupled to the upper end of the detergent box 80 and downwardly extended. In addition, the accommodating unit handle 89 may be downwardly extended to the lower surface of the lower cap 87 so as not to expose the detergent outlet hole 87*a* to the inside of the sub-drum 50.

Accordingly, the wash water may be prevented from splashing over a surface by a warm current generated in the rotating sub-drum 50 and from being drawn into the handle via the detergent discharging unit 86.

For example, as the rising wash water along the inner circumferential surface of the sub-drum 50 is blocked by the lower surface of the lower cap 87, the wash water may be primarily prevented from being drawn into the siphon pipe 86*a*. The detergent outlet hole 87*a* provided towards the center of the sub-drum 50, spaced a preset distance apart from the lateral surface of the sub-drum 50 may secondarily prevent the wash water blocked by the lower surface of the lower cap 87 after rising from being drawn into the siphon pipe 86*a,* even if the wash water blocked by the lower surface of the lower cap 87 after rising flows towards the center of the sub-drum 50 against centrifugal force. In addition, the handle unit may prevent the wash water from being drawn into the detergent outlet hole 87*a*.

Meanwhile, as the opening of the holding area 566 is formed towards the center of the sub-drum 50, an upper through-hole 565 is provided in an upper surface of the holding area 566 to supply the wash water and the detergent to the detergent box 80. Here, the upper surface of the holding area 566 may form the lower surface of the recessed area 561.

The upper through-hole 565 is located in the upper area of the detergent inlet hole 84 formed in the upper surface of the detergent box 80, corresponding to the detergent inlet hole. Accordingly, the inside of the detergent box 80 may communicate with the outside of the sub-drum 50 via the detergent inlet hole 84 and the upper through-hole 565.

Meanwhile, the detergent box 80 may include an accommodation body 82 provided to accommodate the detergent and having a siphon pipe 86*a;* and a body cover 83 detachably coupled to an upper end of the accommodation body 82 and having a siphon cap 86*b*. Here, the body cover 83 may be made of a transparent material such that the user can check the amount of the supplied detergent through the body cover 83.

Hereinafter, the process of discharging the detergent from the detergent box 80 will be described.

In case of supplying the washing detergent to the detergent box 80, the detergent may be loaded via the detergent inlet hole 84 of the detergent box 80 before the washing cycle starts. The user is able to draw the detergent box 80 from the holding area 566 and load the washing detergent into the detergent box 80.

In this instance, water supply is performed by the water supply unit 18 before the sub-drum 50 is rotated at the washing RPM for generating a relatively strong centrifugal force. Once the water supply is completed, the detergent loaded in the detergent box 80 is discharged into the sub-drum 50 via the detergent discharging unit 86, together with the supplied wash water.

Meanwhile, in case of loading a fabric softener into the detergent box, the fabric softener has to be loaded into the detergent box 80 before the final water supply for the rinsing cycle, once the washing cycle is completed. In this instance, the fabric softener may be loaded into the detergent box 80 before a step of rotating the sub-drum 50 at the rinsing RPM among the steps performed before the final water supply.

In this instance, once the sub-drum 50 is rotated at the rinsing RPM, the detergent loaded in the detergent box 80 is one-sided within the detergent box 80 along the direction in which centrifugal force acts. The detergent discharging unit 86 configured to discharge a liquid by using the siphon effect is provided in the detergent box 80 in a state of being one-sided in an opposite direction to the direction in which centrifugal force acts. Even if the detergent is concentrated on some area of the detergent box 80, the height of the detergent near the siphon pipe 86*a* will not rise.

In other words, the first space and the inner space of the water pressure guide may function as a buffering space for temporarily accommodating the detergent one-sided by the centrifugal force. Accordingly, the detergent may not be discharged via the detergent discharging unit 86 by the siphon effect before the water supply from the water supply unit 18.

Once the water supply is performed after that, the detergent loaded into the detergent box 80 may be discharged into the sub-drum 50 via the detergent discharging unit 86, together with the supplied wash water.

Figure 11:
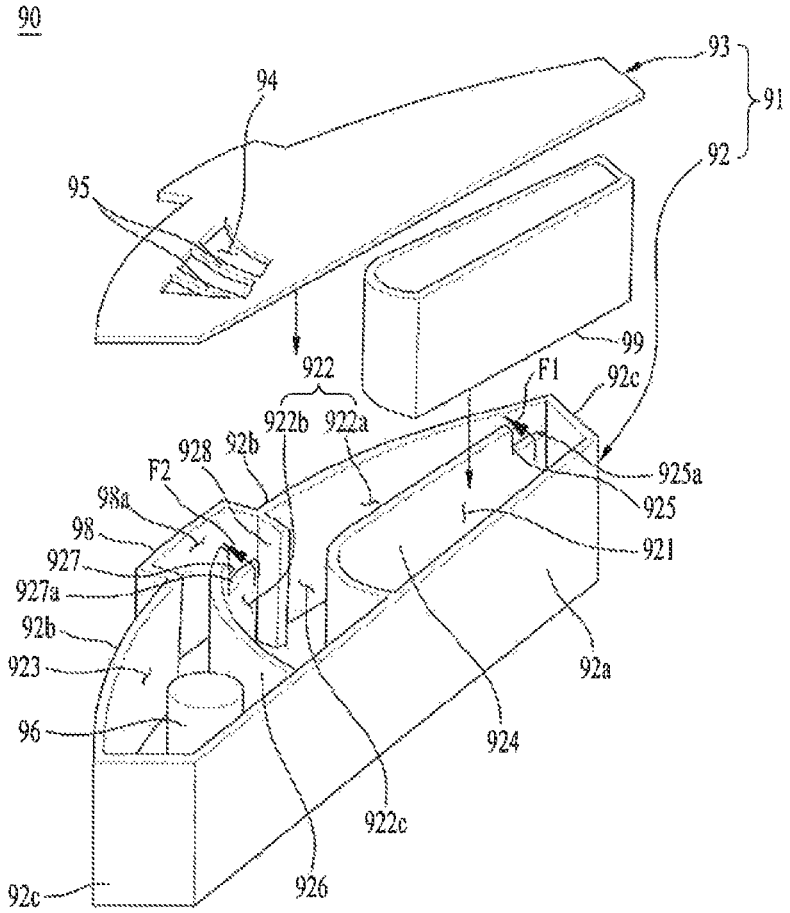
FIG. 11 is an exploded perspective diagram illustrating a further embodiment of the detergent box mounted in the sub-drum shown in FIG. 1.

Hereinafter, referring to FIG. 11, a detergent box 90 according to a further embodiment will be described. FIG. 11 is a perspective diagram illustrating a further embodiment of the detergent box 90 mounted in the sub-drum 50 shown in FIG. 1. The detergent box 90 according to this embodiment may be also provided in the sub-drum 50, like the detergent box 60 according to the above-noted embodiment.

The detergent box 90 according to this embodiment may be partitioned off into a plurality of chambers by a partition wall. The detergent box 90 includes a communication hole formed in the partition wall at a preset height and configured to facilitate communication between the chambers.

The chamber is a space defined by the partition wall and lateral walls of the detergent box 90 and the plurality of the chambers is provided in the detergent box 90. The detergent may be loaded into each of the chambers.

The partition wall may be extended from a lower surface to an upper surface of the detergent box 90. Also, each partition wall has a communication hole penetrating an upper end of the partition wall to allow the detergent to pass through the partition wall after rising along the partition wall, when the centrifugal force generated by the rotation of the sub-drum 50 acts.

Meanwhile, the chambers may be sequentially arranged along a direction in which the centrifugal force acts to allow the detergent to penetrate the communication holes and sequentially pass through the partition walls when the sub-drum 50 is rotated.

Only when the actuation of the centrifugal force makes the detergent penetrate the communication holes and pass through the partition walls sequentially, the chambers, for example, the centers of the cross sectional chamber surfaces may be sequentially arranged along the direction in which the centrifugal force acts. Also, the outer walls among the lateral walls of each chamber may be sequentially arranged along the direction of the centrifugal force actuation, because the outer wall is most distant from the center of the sub-drum 50.

For the sake of easy description, in the detergent box 90 according to this embodiment, the outer walls among the lateral walls of the chambers are sequentially arranged along the direction in which the centrifugal force acts. That is because the outer walls are the most distant from the center of the sub-drum 50.

In this instance, the outer wall may be configured of only the partition wall and the embodiments are not limited thereto. For example, the outer wall may be configured of the partition wall and a lateral wall of the detergent box 90. In the latter case, the partition wall and the lateral wall of the detergent box 90 are in contact with each other, spaced the same distance apart from the center of the sub-drum 50.

When the sub-drum 50 is rotated, the loaded detergent is weighted to one side, in other words, the outer wall of one of the chambers provided in the detergent box 90 according to the arrangement described above and rises up along the outer wall of the chamber according to the size of the centrifugal force. After that, the detergent penetrates the communication hole provided only in the partition wall and move to another chamber.

When the size of the centrifugal force generated by the rotation of the sub-drum is large, the detergent rises high along the outer wall. When the size of the centrifugal force is small, the detergent rises relatively low along the outer wall. In other words, the heights of the partition wall to which the detergent rises are different according to the size of the centrifugal force. Accordingly, if the heights of the communication holes are set different, the detergent penetrates the communication holes only in case corresponding centrifugal forces are actuated, respectively.

The detergent box 90 of this embodiment may include at least two chambers. When two chambers are provided, one accommodates the detergent supplied from outside and the other chamber may accommodate the detergent drawn via the communication hole from the chamber.

The other chamber may have a water inlet hole 94 formed in an upper surface to receive wash water from the water supply unit 18 in the water supply step and a detergent discharging unit 96 provided in a lower surface to discharge water or liquid to the sub-drum 50. The structure of the detergent discharging unit 96 configured of the siphon cap coupled to an upper end of the siphon pipe is the same as the structure described in the former embodiment described above and detailed description thereof is omitted.

Even in this embodiment, a lower cap (not shown) may be provided in a lower surface of the other chamber to prevent the wash water held in the sub-drum 50 from being drawn into the siphon pipe of the detergent discharging unit 96 after rising. The lower cap is the same with that of the former embodiment described above and detailed description is also omitted.

In case two chambers are provided in the detergent box 90, one communication hole is provided in one partition wall. When the height of the communication hole is set, detergent penetrates the communication hole only in case the sub-drum 50 is rotated at a specific RPM. In the water supply step performed after that, the detergent is discharged via the detergent discharging unit 96 together with the wash water.

However, in this instance, it may be repeated that the sub-drum 50 is supplied wash water after the sub-drum is rotated at a preset RPM and wash water again is supplied after being rotated at another RPM. The detergent may not be discharged in the water supply step configured to be performed after the specific RPM described above but after the further water supply steps.

For example, once performing another series of processes in which the water supply step is performed after the sub-drum 50 is rotated to a higher RPM than a target RPM before a series of processes configured to perform a target water supply right after the sub-drum 50 is rotated at a target RPM to discharge detergent, the detergent is discharged in the corresponding water supply in another series of processes and the detergent is not discharged in the target water supply performed after that.

That is because the detergent is drawn into the chamber having the detergent discharging unit 96 when the sub-drum 50 is rotated at the target RPM or more. Once the detergent is drawn into the chamber having the detergent discharging unit 96, the detergent is discharged in the water supply step performed before the target water supply step.

Accordingly, it is necessary to provide a structure configured to discharge detergent to the sub-drum via the detergent discharging unit 96 in the series of the processes configured to perform the target water supply step right after the sub-drum 50 is rotated at the target RPM.

For that, the detergent box 90 of this embodiment includes one or more middle chambers provided between one chamber provided to be supplied detergent from outside and the other chamber provided to discharge the supplied detergent by using the siphon effect. The middle chamber corresponds to a second chamber 922 which will be described later.

The middle chamber is also partitioned by the partition wall and includes a communication hole to communicate with the other chambers. The height of the communication hole formed to draw detergent into the chamber is set to pass the detergent therethrough when the sub-drum 50 is rotated at a first RPM. The communication hole formed to discharge the detergent is located lower than the communication hole formed to draw the detergent and the height of the communication hole for discharging detergent is set so as to pass the detergent therethrough when the sub-drum 50 is rotated at the first RPM. In other words, the heights of the communication holes provided in the partition walls for partitioning off the middle chamber may become gradually lower according to the order of the wash water penetrating the communication holes by centrifugal force.

Moreover, the middle chamber includes a shut-off rib 928 provided to shut off the detergent having penetrated the communication hole for drawing the detergent from flowing into the communication hole for discharging the detergent until the sub-drum 50 is rotated lower than a second RPM. The shut-off rib 928 may project from an inner surface of the outer wall of the middle chamber a preset height vertically.

In this instance, an inlet chamber 922*a* and an outlet chamber 922*b* are provided as the predetermined spaces defined by the shut-off rib 928 and the outer wall. The communication hole for drawing detergent is located in the inlet chamber 922*a* and the communication hole for discharging detergent is located in the outlet chamber 922*b*.

In FIG. 11, the outer wall 92*b* is gently curved to define the inlet chamber and the outlet chamber 922*b*, together with the shut-off rib 928, but the embodiments of the prevent invention are not limited thereto. Alternatively, the outer wall 92*b* is recessed in the direction of the centrifugal force actuation to define the inlet chamber 922*a* and the outlet chamber 922*b*.

When the sub-drum 50 is rotated at the first RPM, for example, the detergent drawn into the middle chamber will not be moved towards the communication hole for discharging detergent by the shut-off rib 928, in a state of being concentrated on a side of the outer wall of the middle chamber by the centrifugal force until the sub-drum 50 is rotated lower than the second RPM. In other words, while the sub-drum 50 is rotated at the first RPM, the detergent is kept in the inlet chamber 922*a*. The height of the shut-off rib 928 is set so as to shut off the detergent.

Once the sub-drum 50 is rotated lower than the second RPM or stopped, the centrifugal force becomes weak and the detergent concentrated to one side of the outer wall flow over the shut-off rib 928 while flowing toward the lower surface of the middle chamber. In other words, the detergent flows down from the inlet chamber 922*a* towards the lower surface of the chamber to be spread on the lower surface wide.

When the rotation speed of the sub-drum 50 rises to the second RPM again, the detergent is concentrated to one side of the outer wall again and some of the detergent is moved to the outlet chamber 922*b* and some of the other detergent is moved to the inlet chamber 922*a*. The detergent moved into the outlet chamber 922*b* rises to the communication hole and penetrates the communication hole to be moved into another chamber.

Accordingly, even though the communication hole for drawing detergent is lower than the communication hole for discharging detergent in the middle chamber, the detergent may not continuously penetrate the two communication holes by the centrifugal force while the sub-drum 50 is rotated at the first RPM.

Moreover, as described above, one or more middle chambers may be provided in the detergent box 90. Accordingly, the heights of the communication holes provided in the partition walls may be set different from each other.

FIG. 11 illustrates one middle chamber provided in the detergent box 90 as one embodiment the detergent box 90 shown in FIG. 11 includes a detergent accommodating unit 91 configured of an accommodation body 92 having an accommodating space formed therein to accommodate detergent; and a body cover 93 detachably provided in an upper area of the accommodation body 92. The detergent accommodating unit 91 may be integrally formed as one body, not divided into the accommodation body 92 and the body cover 93.

The accommodation body 92 includes a body inner wall 92*a* having an outer surface oriented towards the center of the sub-drum 50; an body outer wall 92*b* located in opposite to the body inner wall 92*a*; and a pair of body lateral walls 92*c* provided between the body inner wall 92*a* and the body outer wall 92*b*, facing with each other. The accommodating space for accommodating the detergent as described above may be defined by the body inner wall 92*a*, the body outer wall 92*b*, the pair of the body lateral walls 92*c* and the body cover 93.

A holding guide 98 is projected from an outer surface of the body outer wall 92*b* to be inserted in the guide groove 564, As described above, the holding guide 98 guides the holding of the detergent box 90. A buffering space is provided in the holding guide 98 to accommodate the detergent and the buffering space will be descried later.

The accommodation body 92 includes a first chamber 921, a second chamber 922, a third chamber 923, a first partition wall 924 provided between the first chamber 921 and the second chamber 922 and a second partition wall 926 provided between the second chamber 922 and the third chamber 923.

The first chamber 921 is supplied with detergent from outside and the first chamber is the space which accommodates the supplied detergent firstly. The second chamber 922 is corresponding to the middle chamber described above and the third chamber 923 is the place having the detergent discharging unit 96 formed therein. The first chamber 921, the second chamber 922 and the third chamber 923 may be sequentially arranged to allow the detergent to be flowing from the first chamber 921 to the third chamber 923 through the second chamber 922 by the centrifugal force of the rotating sub-drum 50. Accordingly, when the sub-drum 50 is rotated, the detergent loaded in the first chamber 921 is concentrated towards the first partition wall 924 and the detergent loaded in the second chamber 922 is concentrated towards the second partition wall 926.

As the first partition wall 924 and the second partition wall 926 are extended from the lower surface of the accommodation body 92 to the body cover 93, the first chamber 921 and the second chamber 922 may communicate with each other via a first communication hole 925 provided in the first partition wall 924, which will be described later. The second chamber 922 and the third chamber 923 may communicate with each other only via a second communication hole 927 provided in the first partition wall 924, which will be described later.

The first communication hole 925 is provided to penetrate an upper end of the first partition wall 924 and the second communication hole 927 is provided to penetrate an upper end of the second partition wall 926. The first communication hole 925 is set higher than the second communication hole 927. For example, as shown in FIG. 11, the height from the lower surface of the first chamber 921 to a lower surface 925*a* of the first communication hole 925 may be set as 25 mm and the height from the lower surface of the second chamber 922 to a lower surface 927*a* of the second communication hole 927 may be set as 20 mm.

Accordingly, the detergent held in the first chamber 921 rises to the lower surface 925*a* of the first communication hole 925 along the first partition wall 924 and then penetrates the first communication hole 925 to be loaded into the second chamber 922, when the centrifugal force of the rotating sub-drum 50 is actuated in the detergent. The detergent loaded into the second chamber 922 rises to the lower surface 927*a* of the second communication hole 927 along the second partition wall 926 and penetrates the second communication hole 927 to be loaded into the third chamber 923, when the centrifugal force generated by the rotation of the sub-drum 50 is actuated in the detergent. Here, the first RPM may be set as approximately 400 rpm and the second rpm may be set as approximately 350 rpm.

Accordingly, the first communication hole 925 is corresponding to the communication hole configured to draw the detergent into the middle chamber and the second communication hole is corresponding to the communication hole configured to discharge the detergent from the middle chamber.

Meanwhile, the second chamber 922 includes a shut-off rib 928 configured to prevent the detergent drawn from the first chamber 921 from reaching the second communication hole 927 provided in the second partition wall 926 from the second chamber 922 while the sub-drum 50 is rotated at the first rpm.

The shut-off rib 928 is provided between the first communication hole 925 ad the second communication hole 927, projected a preset height from the outer wall located most distant from the center of the sub-drum 50. Moreover, the shut-off rib is extended from the lower surface of the accommodation body 92 to the body cover 93. Here, the outer wall is configured of the second partition wall 926 or the body outer wall 92*b* of the detergent box 90 or the combination of the second partition wall 926 and the body outer wall 92*b*. In this instance, the shut-off rib 928 may be provided in either of the second partition wall 926 and the body outer wall 92*b*, only if it is located in the outer wall located between the first communication hole 925 and the second communication hole 927.

The shut-off rib 928 may partition off the inner space of the second chamber 922 into an inlet chamber 922*a* and an outlet chamber 922*b*. The shut-off rib 928 is spaced apart from an opposite lateral wall to the outer wall. The inlet chamber 922*a* and the outlet chamber 922*b* may communicate with each other via a flow hole formed between the shut-off rib 928 and the opposite lateral wall facing the outer watt.

The third chamber 923 includes a detergent discharging unit 96 having a siphon pipe configured to facilitate communication between the inside of the third chamber 923 and the inside of the sub-drum 50; and a siphon cap configured to form a siphon path by covering the siphon pipe.

The detergent discharging unit 96 is concentrated to the other side in the reverse direction of the centrifugal force actuating direction, like the embodiment described above. Accordingly, the space formed in the direction in which the centrifugal force is actuated is larger than the space in the reverse direction of the centrifugal force actuating direction, such that it may function as a buffering space for temporarily accommodating detergent when the centrifugal force is actuated. Moreover, the buffering space 98*a* formed in the holding guide 98 may be in communication with the third chamber 923, so as to strengthen the buffering function.

A lower cap (not shown) may be provided in the third chamber 923 to prevent the wash water held in the sub-drum 50 from being drawn into the siphon pipe after rising and the lower cap is the same with the lower cap described above and description thereof is omitted.

The body cover 93 includes a wash water inlet hole 94 penetrating the body cover 93 to draw in wash water; one or more inlet guide ribs 95 crossing the wash water inlet hole 94 to guide the wash water downwardly. The wash water inlet hole 94 is located in an upper area of the third chamber 923, when the body cover 93 is coupled to the accommodation body.

Meanwhile, the detergent box 90 may further include a detergent container 99 detachably provided in the first chamber 921. The detergent container 99 is retractable with respect to the first chamber 921, with an open upper surface. In this instance, the upper surface of the detergent container 99 may be as high as or lower than the first communication hole 925 to allow the accommodated detergent to pass through the first communication hole 925 via the open upper surface.

Hereinafter, referring to FIG. 11, the process of discharging detergent from the detergent box 90 according to this embodiment will be described. To describe the process, it is premised that the washing process is configured of the washing cycle, the rinsing cycle and the dry-spinning cycle which include following steps, respectively. The washing cycle includes a wash water supply step; a washing step of rotating the sub-drum 50 at the washing rpm; and a washing-spinning step. The rinsing cycle includes a primary rinsing water supply step; a first rinsing step of rotating the sub-drum 50 at the rinsing rpm; a rinsing intermediate spinning step; a second rinsing water supply step; and a second rinsing step of rotating the sub-drum 50 at the rinsing rpm. The dry-spinning cycle includes an intermediate spinning cycle; and a main spinning step.

Moreover, to avoid repetition of description, a process of discharging fabric softener will be described. In case the detergent box 90 is used in loading a washing detergent, it is premised that two spinning steps should be performed before the above wash water supplying step. That is the same with the process of discharging the fabric softener. Accordingly, the fabric softener may include a detergent which is described as follows.

First of all, the user need not load the detergent in the middle of the washing process. The user is able to directly load the detergent in the first chamber 921 of the detergent box 90 or hold the detergent container 99 accommodating the detergent in the first chamber 921, before starting the washing process.

After that, when the washing water supply step starts, some of the wash water is discharged into the sub-drum and some of the other wash water is drawn into the third chamber 923 via the wash water inlet hole 94 of the detergent box 90.

In this instance, there is no detergent in the third chamber 923 and only the loaded wash water is discharged via the detergent discharging unit 96.

Once the wash water supply is completed, the sub-drum 50 is rotated at the washing rpm and the washing step is performed. The washing rpm is lower than the first rpm and the detergent loaded in the first chamber 921 cannot penetrate the first communication hole 925.

Once the washing step is completed, the washing spinning step is performed and the sub-drum 50 is rotated at the first rpm. In the washing spinning step, the detergent loaded in the first chamber 921 penetrates the first communication hole 925 along an arrow F1 and is drawn into the second chamber 922. Here, the first communication hole 925 functions as a path.

The detergent drawn into the second chamber 922 is temporarily held in the inlet chamber 922*a* until the tub-drum 50 is rotated at a lower rpm than the second rpm. In other words, the detergent is shut off by the shut-off rib 928 not to flow.

Once the rotational speed of the sub-drum 50 is lowered to an rpm lower than the second rpm from the first rpm, the detergent held in the inlet chamber 922*a* downwardly flows from the inlet chamber 922*a* and starts to be spread wide on the lower surface of the second chamber 922.

After that, the first rinsing water supply step is performed but the detergent is not drawn in the third chamber 923 at this time such that only wash water may be drawn into the third chamber 923 and discharged again.

After the completion of the first rinsing water supply step, the first rinsing step is performed. The rinsing rpm is lower than the second rpm and the detergent cannot penetrate the second communication hole 927.

Once the first rinsing step is completed, the rinsing intermediate spinning step starts and the sub-drum 50 is rotated at the second rpm. During the rinsing intermediate spinning step, the detergent held in the lower surface of the second chamber 922 to a preset height may flow towards the outer wall again. Some of the detergent flows into the outlet chamber 922*b* partitioned by the shut-off rib 928 and some of the other detergent flows into the inlet chamber 922*a*. The detergent drawn into the outlet chamber 922*b* is drawn into the third chamber 923 through the second communication hole 927 along an arrow F2, while the sub-drum 50 is rotated at the second rpm. Here, the second communication hole 927 may form a path like the first communication hole 925. Discharging of detergent through communication holes (e.g., the first communication hole 925 and the second communication hole 927) may be controlled by setting a height of the communication holes in a respective partition wall. The detergent box 90 may be configured to discharge detergent through communication holes based on a magnitude of centrifugal force generated by rotation of the sub-drum 50.

With the completion of the rinsing intermediate spinning step, the second rinsing water supply step starts. When the second rinsing water supply is performed, the wash water discharged from the water supply unit 18 is drawn into the third chamber 923 via the wash water inlet hole 94. The wash water drawn into the third chamber 923 is discharged into the sub-drum 50 by the wash water discharging unit 96 using the siphon effect, together with the detergent.

After that, the second rinsing step of rotating the sub-drum 50 at the rinsing rpm is performed and the laundry loaded in the sub-drum 50 is rinsed together with the detergent. With the completion of the second rinsing step, the spinning step including the intermediate step and the main spinning step is performed. In the embodiments described above, the detergent box including the siphon pipe may be the detergent box for loading a liquid fabric softener. The detergent box for loading the washing detergent may not include the siphon pipe.

The liquid or solid washing detergent is supplied to the inside of the sub-drum, together with the wash water, as the wash water is supplied to the detergent box. In other words, the point in time when the washing detergent is supplied to the sub-drum is the point of washing water supply. Accordingly, the point of supplying the washing detergent may be performed precisely. In other words, it is less likely to supply the washing detergent at an unnecessary point in time by the rotation of the sub-drum.

On the other hand, the liquid fabric softener has to be supplied at a specific point in time, especially, in the second rinsing step or the final rinsing step. Accordingly, the sub-drum 50 might be rotated at a high rpm in the washing, rinsing or intermediate spinning step before a specific point in time. The liquid fabric softener is likely to be supplied by such rotation at an unnecessary point in time.

With that reason, the siphon pipe may be provided in a center area of the detergent box in a circumferential direction or a center area of the chamber. In other words, when a proper amount of liquid fabric softener is loaded, the fabric softener is concentrated in a direction which becomes farther from the siphon pipe by centrifugal force (in other words, along both sides of the circumferential direction). Accordingly, only unless the wash water is forcibly supplied, the supply of the fabric softener to the sub-drum may be prevented. Of course, the wash water may be forcibly supplied and the siphon effect may be achieved at a proper point in time.

Control for the location of the drum is performed by the controller to locate the detergent box accommodating the liquid fabric softener under the water supply unit and the operation of the water supply unit may be controlled. The wash water falling from the water supply unit is supplied to the detergent box and the fabric softener together with the wash water may be loaded into the sub-drum by the siphon effect.

Meanwhile, the detergent box may include a detergent box for the washing detergent and another detergent box for the fabric softener independently. The boxes may face each other. For example, the two boxes may be provided in both sides of the sub-drum so as to face each other.

The detergent box is mounted in the sub-drum and it has to be small. Accordingly, it is not easy to separately load several detergents in the small box. Of course, it is not easy to form the structure for separately loading several detergents in the small detergent box. When the user loads the detergents by using a detergent container or spoon, the detergents might be mixed with each other in the small detergent box. Accordingly, the process of loading the detergents may be very inconvenient.

To solve the problem, separated detergent boxes may be mounted. As one example, the detergent box for the washing detergent may be always located in a left side and the detergent box for the fabric softener may be always located in a right side of the sub-drum. In that state, the sub-drum having the boxes located therein may be mounted in the drum.

Accordingly, when performing the location control of the drum, the control unit may recognize the locations of the detergent box. In the washing cycle or the rinsing cycle in which no fabric softener is loaded, wash water may be supplied to the sub-drum via the detergent box for the washing detergent In the rinsing cycle in which the fabric softener is loaded (as one example, the second rinsing cycle), wash water may be supplied to the sub-drum via the detergent box for the fabric softener.

Accordingly, it is very convenient to use the detergents in performing washing in the sub-drum as well as the drum.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

INDUSTRIAL APPLICABILITY

Industrial applicability of the present invention is included in the description of the specific embodiments.

What is claimed is:

1. A laundry treating apparatus configured to be disposed on a reference plane, the laundry treating apparatus comprising:

a tub provided to hold wash water;

a drum rotatably provided in the tub;

a sub-drum detachably mounted to an inner circumferential surface of the drum, the sub-drum configured to wash laundry independent from the drum;

a water supply unit configured to supply wash water; and a detergent box provided in the sub-drum and configured to store wash detergent therein, the detergent box comprising a detergent discharging unit configured to discharge wash water supplied from the water supply unit and detergent into the sub-drum, wherein the detergent box comprises:

a plurality of chambers partitioned off by a plurality of partition walls and configured to accommodate detergent;

a plurality of communication holes provided in the partition walls, the communication holes disposed at preset heights and configured to discharge accommodated detergent sequentially among the plurality of chambers according to a magnitude of a centrifugal force generated by rotation of the sub-drum;

a chamber of the plurality of chambers defined by a shut-off rib projecting from an inner surface, the shut-off rib configured to selectively shut off passage of detergent drawn in via a communication hole associated with one of the chambers according to the magnitude of the centrifugal force, respective heights of the plurality of communication holes decreasing according to a sequence of the plurality of partition walls through which wash water is configured to pass by the centrifugal force.

2. The laundry treating apparatus according to claim 1, wherein the detergent box comprises a wash water inlet hole at an upper side, and the detergent box is configured such that wash water falling from the water supply unit is drawn into the detergent box via the wash water inlet hole.

3. The laundry treating apparatus according to claim 1, wherein the detergent discharging unit is configured to discharge detergent together with wash water by a siphon effect.

4. The laundry treating apparatus according to claim 1, wherein the detergent discharging unit comprises:

a siphon pipe in communication with an inside of the detergent box and an inside of the sub-drum; and a siphon cap configured to form a siphon path by covering the siphon pipe.

5. The laundry treating apparatus according to claim 4, wherein the detergent box is provided at an upper end of the sub-drum and the sub-drum comprises a lower cap provided under the siphon pipe and configured to prevent wash water held in the sub-drum from being drawn into the siphon pipe after rising along an inner circumferential surface of the sub-drum during the rotation of the sub-drum.

6. The laundry treating apparatus according to claim 1, wherein the detergent box is retractable in a radial direction from an inside of the sub-drum or an upward direction with respect to the sub-drum.

7. The laundry treating apparatus according to claim 1, wherein the sub-drum comprises a holding area that is recessed and configured to hold the detergent box, the holding area comprises:

a guide groove formed by recessing one side of the holding area configured to guide insertion of the detergent box, and the detergent box comprises a holding guide configured to cooperate with the guide groove, wherein the holding guide is projected from an outer wall of the detergent box.

8. The laundry treating apparatus according to claim 7, wherein the holding guide includes a buffering space configured to accommodate detergent concentrated in a direction of a centrifugal force generated by rotation of the sub-drum.

9. The laundry treating apparatus according to claim 1, wherein the drum has a circular cross section, and the sub-drum comprises:

a coupling area coupled to the inner circumferential surface of the drum; and a spaced area spaced a preset distance apart from the inner circumferential surface of the drum, and the coupling area and the spaced area are alternately provided along a circumference of the sub-drum.

10. The laundry treating apparatus according to claim 9, wherein the detergent box is adjacent to the coupling area.

11. The laundry treating apparatus according to claim 9, wherein the sub-drum further comprises:

a body provided to hold laundry and wash water; and a sub-cover coupled to an upper surface of the body and having a laundry introduction opening to load laundry, the sub-cover comprising a handle unit formed by recessing one side of the sub-cover and provided adjacent to the coupling area.

12. The laundry treating apparatus according to claim 11, wherein the detergent box is provided under the handle unit.

13. The laundry treating apparatus according to claim 1, wherein the detergent box comprises:

an accommodation body in which the plurality of the chambers is provided; and a body cover detachably coupled to an upper end of the accommodation body.

14. The laundry treating apparatus according to claim 1, wherein the detergent box comprises:

a first chamber configured to supply fabric softener;

a second chamber configured to accommodate the fabric softener that flows from the first chamber as the sub-drum rotates at a first rpm in a dry-spinning cycle after a washing cycle;

a third chamber configured to accommodate the fabric softener that flows from the second chamber as the sub-drum is rotated at a second rpm lower than the first rpm in the dry-spinning after a first rinsing cycle, wherein the detergent discharging unit is configured to discharge the fabric softener together with wash water supplied to the third chamber from the water supply unit in a second rinsing cycle into the sub-drum by a siphon effect.

15. The laundry treating apparatus according to claim 1, wherein the detergent box comprises:

a first detergent box provided to accommodate a washing detergent; and a second detergent box provided to accommodate a fabric softener and provided in a reverse side of the first detergent box.

16. The laundry treating apparatus according to claim 15, wherein the sub-drum comprises:

a sub-cover having a laundry introduction opening to load laundry; and a handle unit provided in each of both sides of the sub-cover, wherein the first detergent box and the second detergent box are provided under the handle unit.

17. The laundry treating apparatus according to claim 15, further comprising:

a control unit configured to control the first detergent box to be located under the water supply unit during a washing cycle and control a water supply of the water supply unit, wherein the control unit is configured to control the second detergent box to be located under the water supply unit during a rinsing cycle and control the water supply of the water supply unit.

18. The laundry treating apparatus according to claim 15, wherein a siphon pipe is provided only in the second detergent box, and the siphon pipe is located at a center of the second detergent box in a circumferential direction of the second detergent box.

* * * * *